US010327567B2

(12) United States Patent
Oakes

(10) Patent No.: US 10,327,567 B2
(45) Date of Patent: Jun. 25, 2019

(54) CUTLERY DISPENSER

(71) Applicant: GPCP IP Holdings LLC, Atlanta, GA (US)

(72) Inventor: Shawn A. Oakes, Ripon, WI (US)

(73) Assignee: GPCP IP Holdings LLC, Atlanta, GA (US)

( * ) Notice: Subject to any disclaimer, the term of this patent is extended or adjusted under 35 U.S.C. 154(b) by 0 days.

(21) Appl. No.: 15/621,247

(22) Filed: Jun. 13, 2017

(65) Prior Publication Data

US 2017/0354270 A1 Dec. 14, 2017

Related U.S. Application Data

(60) Provisional application No. 62/349,559, filed on Jun. 13, 2016.

(51) Int. Cl.
*A47F 1/12* (2006.01)
*A47F 1/10* (2006.01)

(52) U.S. Cl.
CPC ..... *A47F 1/10* (2013.01); *A47F 1/12* (2013.01); *A47F 1/125* (2013.01); *A47F 2001/103* (2013.01)

(58) Field of Classification Search
CPC ..... A47K 10/427; A47F 10/06; A47F 1/125
(Continued)

(56) References Cited

U.S. PATENT DOCUMENTS 1,560,938 A 11/1925 Lund
2,431,121 A 11/1947 Hunter
(Continued)

FOREIGN PATENT DOCUMENTS

CA 3020168 A1 10/2017
CA 3021819 A1 11/2018
(Continued)

OTHER PUBLICATIONS

International Search Report of Intl. Patent Application No. PCT/US2017/037233, mailed by the International Searching Authority dated Sep. 5, 2017.
(Continued)

*Primary Examiner* — Gene O Crawford
*Assistant Examiner* — Ayodeji T Ojofeitimi

(57) ABSTRACT

The present disclosure provides a cutlery dispenser for dispensing cutlery utensils. The cutlery dispenser may include a housing, a cover, a wedge protrusion, and a pair of sweeper arms. The housing may include an interior space and be configured to receive a number of cutlery utensils loaded therein. The cover may enclose a portion of the interior space and be configured to move between a closed position for dispensing the loaded cutlery utensils from the interior space and an open position for loading the cutlery utensils into the interior space. The wedge protrusion may be configured to engage a leading one of the loaded cutlery utensils when the cover is in the closed position and to disengage the leading one of the loaded cutlery utensils when the cover is in an open position. The sweeper arms may be configured to engage the leading one of the loaded cutlery utensils when the cover is in an open position and to disengage the leading one of the loaded cutlery utensils when the cover is in the closed position.

22 Claims, 23 Drawing Sheets

(58) Field of Classification Search
USPC ..... 221/33–63, 1, 279
See application file for complete search history.

(56) References Cited

U.S. PATENT DOCUMENTS

| | | | | |
|---|---|---|---|---|
| 2,503,741 | A | 4/1950 | Johnson | |
| 2,646,874 | A | 7/1953 | Testi | |
| 2,671,555 | A | 3/1954 | Shnitzler | |
| 3,180,489 | A | 4/1965 | McGinn | |
| 3,679,096 | A | 7/1972 | Musser | |
| 3,749,234 | A | 7/1973 | Gero | |
| 3,861,563 | A | 1/1975 | Lisbin et al. | |
| 4,005,801 | A | 2/1977 | Musser | |
| 4,530,445 | A * | 7/1985 | Decker | B43M 99/009 206/340 |
| 4,798,319 | A | 1/1989 | James, Jr. | |
| D305,709 | S | 1/1990 | Blignaut | |
| 5,131,562 | A | 7/1992 | Brown | |
| 5,263,596 | A | 11/1993 | Williams | |
| 6,250,498 | B1 | 6/2001 | Lovejoy | |
| 6,257,443 | B1 * | 7/2001 | LaCount | A47K 10/427 221/35 |
| 7,424,957 | B1 | 9/2008 | Luberto | |
| D584,084 | S | 1/2009 | Tucker | |
| D607,245 | S | 1/2010 | Tucker | |
| 7,661,553 | B2 * | 2/2010 | Zeiron | A47K 10/427 221/305 |
| 7,669,732 | B2 | 3/2010 | Njaastad | |
| 7,690,518 | B2 | 4/2010 | Fincher et al. | |
| 7,900,797 | B1 | 3/2011 | Witcraft | |
| 7,905,370 | B2 | 3/2011 | Leonetti | |
| 8,272,533 | B1 | 9/2012 | D'Amelia et al. | |
| 9,049,949 | B1 | 6/2015 | Taylor | |
| 9,226,598 | B1 | 1/2016 | Knope et al. | |
| 9,439,518 | B2 | 9/2016 | Oakes | |
| 9,560,920 | B2 | 2/2017 | Oakes | |
| D783,303 | S | 4/2017 | Roche | |
| 9,700,153 | B2 | 7/2017 | Snyder et al. | |
| 2004/0089670 | A1 | 5/2004 | Goeking et al. | |
| 2007/0131705 | A1 | 6/2007 | Behravesh et al. | |
| 2009/0194557 | A1 | 8/2009 | Van Deursen | |
| 2010/0147869 | A1 | 6/2010 | Iliffe et al. | |
| 2013/0043272 | A1 | 2/2013 | Oakes | |
| 2013/0193157 | A1 | 8/2013 | Jongen et al. | |
| 2015/0041484 | A1 * | 2/2015 | Oakes | A47F 1/126 221/1 |
| 2015/0265108 | A1 | 9/2015 | Brickl et al. | |
| 2015/0289679 | A1 * | 10/2015 | Oakes | A47F 1/125 221/1 |
| 2019/0075940 | A1 | 3/2019 | Pierson et al. | |

FOREIGN PATENT DOCUMENTS

| | | | |
|---|---|---|---|
| CN | 203828595 | U | 9/2014 |
| CN | 103919422 | B | 7/2015 |
| CN | 103960919 | B | 2/2017 |
| EP | 1864596 | A2 | 12/2007 |
| PL | 200112 | A1 | 12/2008 |
| WO | 01/05280 | A1 | 1/2001 |
| WO | 01/05281 | A1 | 1/2001 |
| WO | 2004/028309 | A1 | 4/2004 |
| WO | 2016155644 | A1 | 10/2016 |
| WO | 2017/139525 | A1 | 8/2017 |
| WO | 2018006062 | A1 | 1/2018 |

OTHER PUBLICATIONS

Written Opinion of Intl. Patent Application No. PCT/US2017/037233, mailed by the International Searching Authority dated Sep. 5, 2017.

* cited by examiner

CUTLERY DISPENSER

FIELD OF THE DISCLOSURE

The present disclosure relates generally to cutlery utensils and more particularly to a cutlery dispenser and related methods for dispensing disposable cutlery utensils one at a time in a controlled and hygienic manner with simplified components.

BACKGROUND OF THE DISCLOSURE

Restaurants and other types of retail outlets often provide disposable cutlery utensils in open self-serve dispensing bins. In this manner, consumers may retrieve a cutlery utensil, such as a fork, a spoon, a knife, a spork, and the like, directly from a dispensing bin. Such open dispensing bins, however, may have at least the appearance of being somewhat unhygienic because the cutlery utensils may not be enclosed or wrapped. As a result, consumers may react negatively because the remaining cutlery utensils may be touched or otherwise contacted while a selected cutlery utensil is being removed from the dispensing bin.

To address these concerns relating to cutlery utensils, enclosed cutlery dispensers have been used. Cutlery utensils may be placed and stored in a utensil compartment of the dispenser and may be dispensed therefrom one at a time on command. Generally described, such cutlery dispensers may operate via gravity or via a dispensing lever, a rotating belt, and/or other types of dispensing mechanisms. The mechanics of such dispensing mechanisms, however, may be complex and hence may be subject to malfunction. Further, such cutlery dispensers typically may be somewhat bulky and may occupy a significant footprint on an already crowded countertop and the like.

There is thus a desire for an improved cutlery dispenser for cutlery utensils. Preferably, such an improved cutlery dispenser may be easy and hygienic to load and to dispense the cutlery utensils therefrom and may provide a reduced overall footprint and simplified dispensing mechanics.

SUMMARY OF THE DISCLOSURE

In one aspect, the present disclosure provides a cutlery dispenser for dispensing cutlery utensils which may be at least partially wrapped. The cutlery dispenser may include a housing, a cover, a wedge protrusion, and a pair of sweeper arms. The housing may include an interior space configured to receive a number of cutlery utensils loaded therein. The cover may enclose a portion of the interior space and be configured to move between a closed position for dispensing the loaded cutlery utensils from the interior space and an open position for loading the cutlery utensils into the interior space. The wedge protrusion may be configured to engage a leading one of the loaded cutlery utensils when the cover is in the closed position and to disengage the leading one of the loaded cutlery utensils when the cover is in an open position. The sweeper arms may be configured to engage the leading one of the loaded cutlery utensils when the cover is in an open position and to disengage the leading one of the loaded cutlery utensils when the cover is in the closed position.

In another aspect, the present disclosure provides a cutlery dispenser for dispensing wrapped or partially wrapped cutlery utensils. The cutlery dispenser may include a housing, a cover, and a trough. The housing may include an interior space configured to receive a number of cutlery utensils loaded therein. The cover may enclose a portion of the interior space and be configured to move between a closed position for dispensing the loaded cutlery utensils from the interior space and an open position for loading the cutlery utensils into the interior space. The trough may be attached to the cover and configured to receive handles of the cutlery utensils therein, and the trough may include a stop wall positioned at or near an end of the trough opposite the cover and configured to engage a trailing one of the cutlery utensils when the dispenser is at a maximum fill level.

In still another aspect, the present disclosure provides a cutlery dispenser for dispensing wrapped or partially wrapped cutlery utensils. The cutlery dispenser may include a housing, a cover, and a trough. The housing may include an interior space configured to receive a number of cutlery utensils loaded therein. The cover may enclose a portion of the interior space and be configured to translate between a closed position for dispensing the loaded cutlery utensils from the interior space and an open position for loading the cutlery utensils into the interior space. The trough may be attached to the cover and configured to receive handles of the cutlery utensils therein, such that the cutlery utensils are oriented in a substantially upright manner with functional heads of the cutlery utensils positioned above the handles.

In another aspect, the present disclosure provides a cutlery dispenser for dispensing wrapped or partially wrapped cutlery utensils. The cutlery dispenser may include a housing, a cover, and a wedge protrusion. The housing may include an interior space configured to receive a number of cutlery utensils loaded therein. The cover may enclose a portion of the interior space and be configured to move between a closed position for dispensing the loaded cutlery utensils from the interior space and an open position for loading the cutlery utensils into the interior space. The wedge protrusion may be configured to engage a leading one of the loaded cutlery utensils when the cover is in the closed position and to disengage the leading one of the loaded cutlery utensils when the cover is in an open position. The wedge protrusion may include a contact surface oriented at an acute angle relative to an interior surface of the cover.

In still another aspect, the present disclosure provides a cutlery dispenser for dispensing wrapped or partially wrapped cutlery utensils. The cutlery dispenser may include a housing, a cover, and a follower arm. The housing may include an interior space configured to receive a number of cutlery utensils loaded therein. The cover may enclose a portion of the interior space and be configured to move between a closed position for dispensing the loaded cutlery utensils from the interior space and an open position for loading the cutlery utensils into the interior space. The follower arm may be attached to the housing and configured to pivot relative to the housing. The follower arm may include one or more indicators configured to indicate a fill level of the loaded cutlery utensils or available capacity of the dispenser.

In another aspect, the present disclosure provides a cutlery dispenser for dispensing wrapped or partially wrapped cutlery utensils. The cutlery dispenser may include a housing and a cover. The housing may include an interior space configured to receive a number of cutlery utensils loaded therein. The cover may enclose a portion of the interior space and be configured to move between a closed position for dispensing the loaded cutlery utensils from the interior space and an open position for loading the cutlery utensils into the interior space. The cover may include a slot or other opening configured to receive a skewer to facilitate loading of the cutlery utensils into the interior space.

These and other aspects and improvements of the present disclosure will become apparent to one of ordinary skill in the art upon review of the following detailed description when taken in conjunction with the several drawings and the appended claims.

BRIEF DESCRIPTION OF THE DRAWINGS

The detailed description is set forth with reference to the accompanying drawings illustrating example embodiments of the disclosure, in which use of the same reference numerals indicates similar or identical features or components. Certain embodiments may include features and/or components other than those illustrated in the drawings, and some features and/or components may not be present in certain embodiments.

DETAILED DESCRIPTION

Figure 1A:
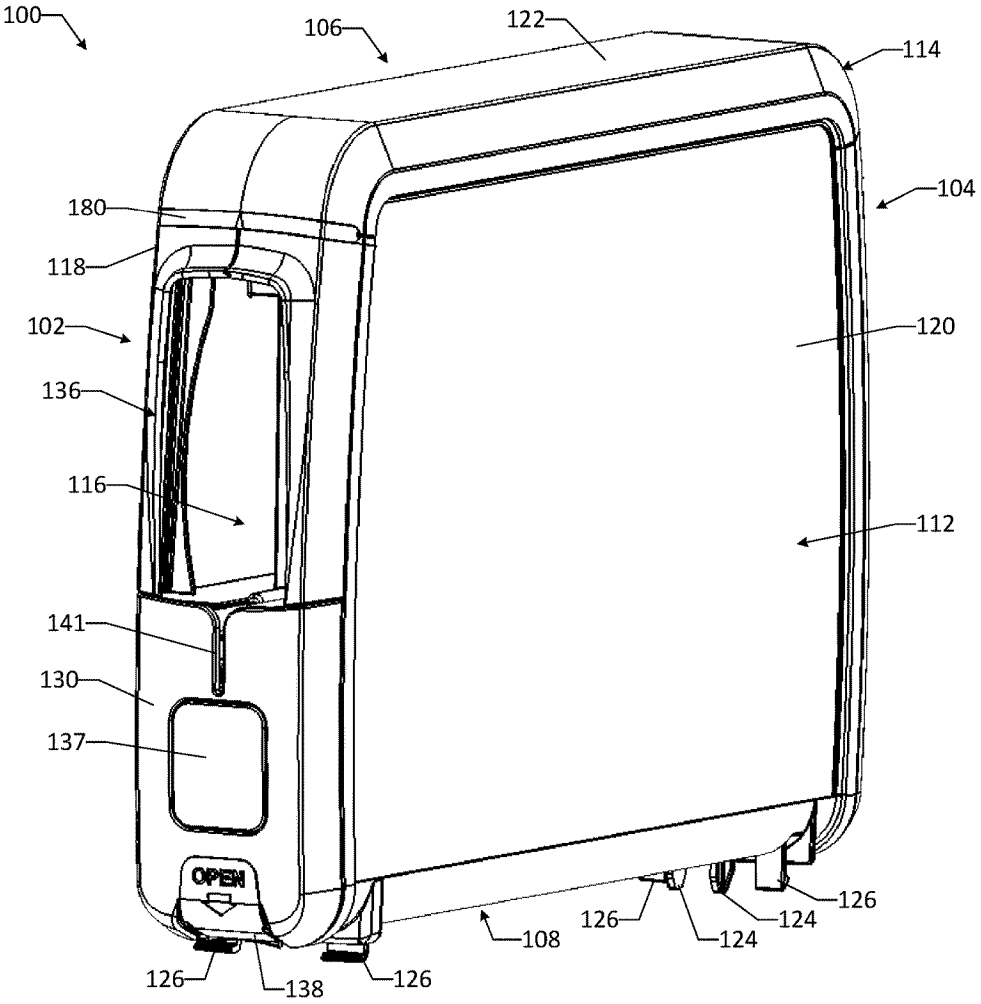
FIG. 1A is a perspective view of a cutlery dispenser as may be described herein.
Figure 1B:
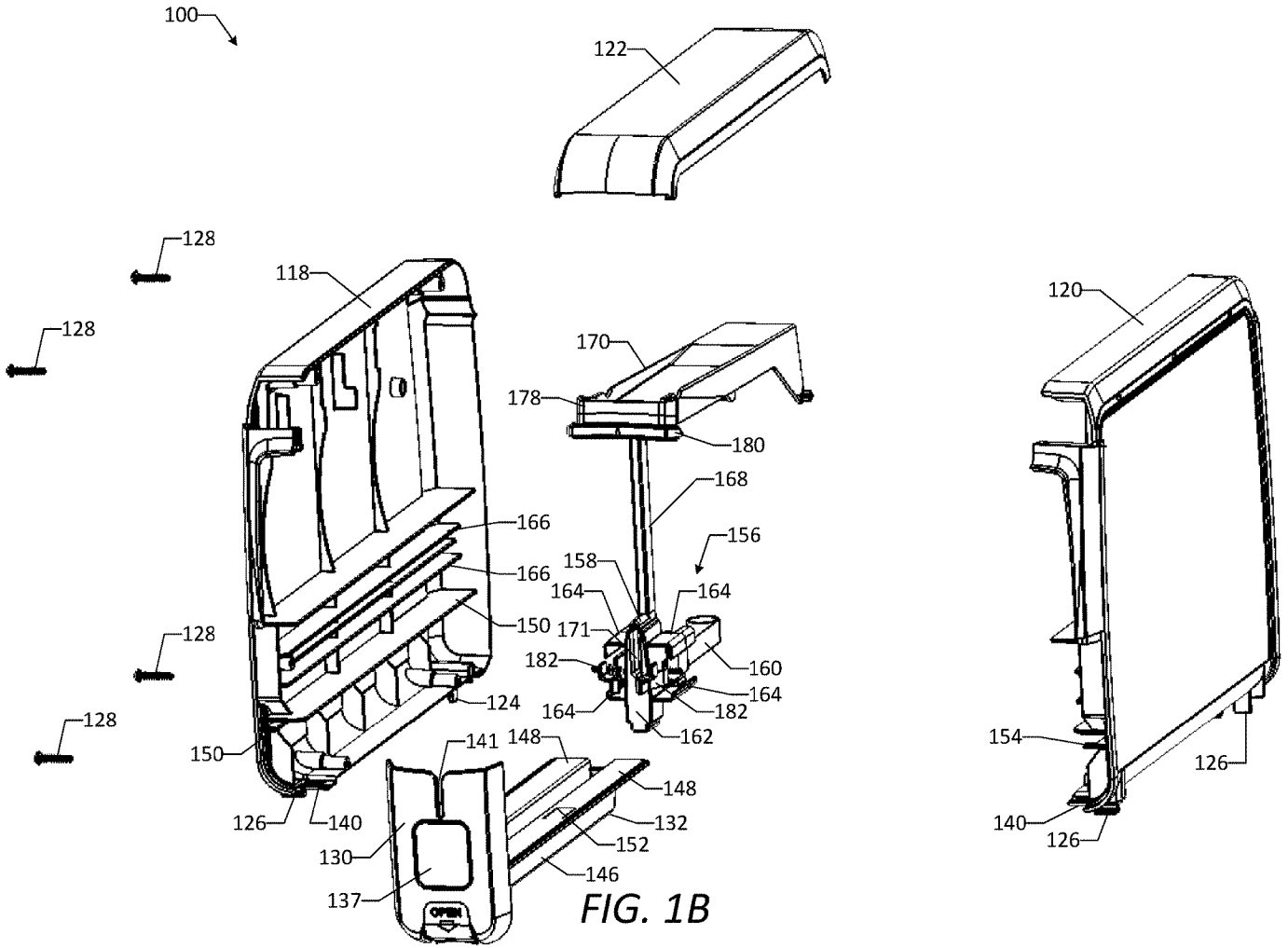
FIG. 1B is a partially-exploded perspective view of the cutlery dispenser of FIG. 1A.
Figure 1C:
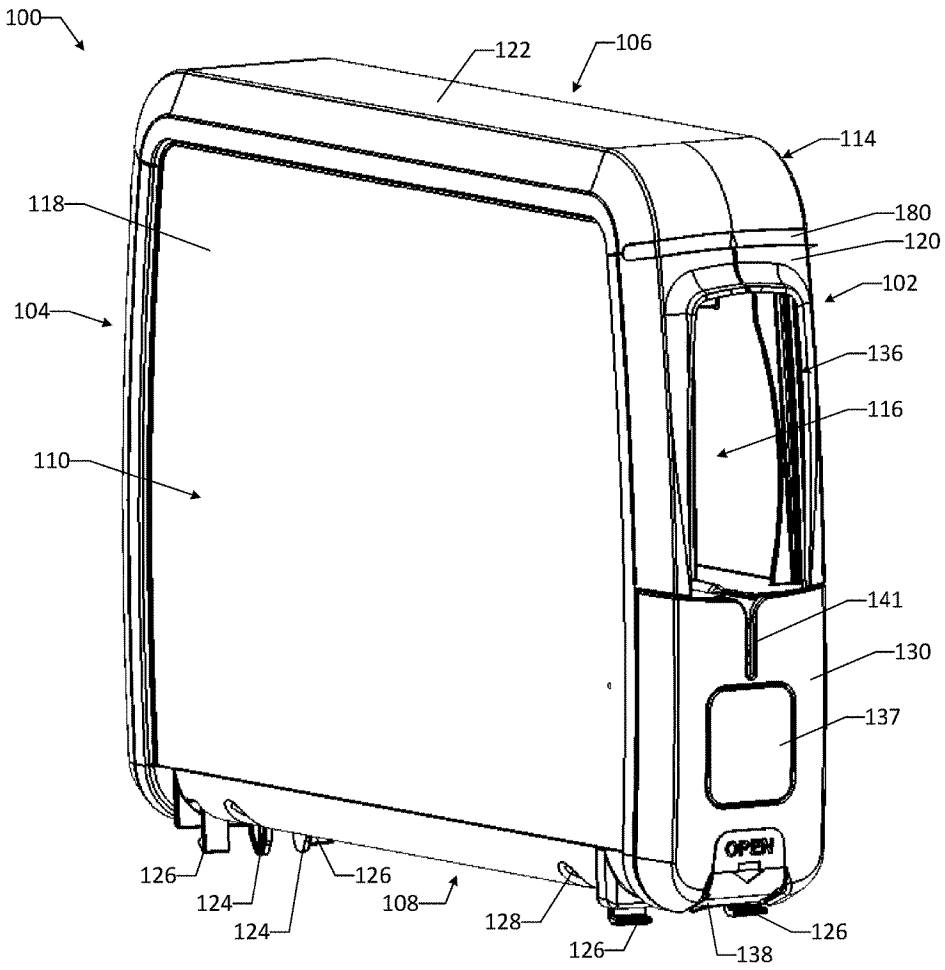
FIG. 1C is a perspective view of the cutlery dispenser of FIG. 1A.
Figure 1D:
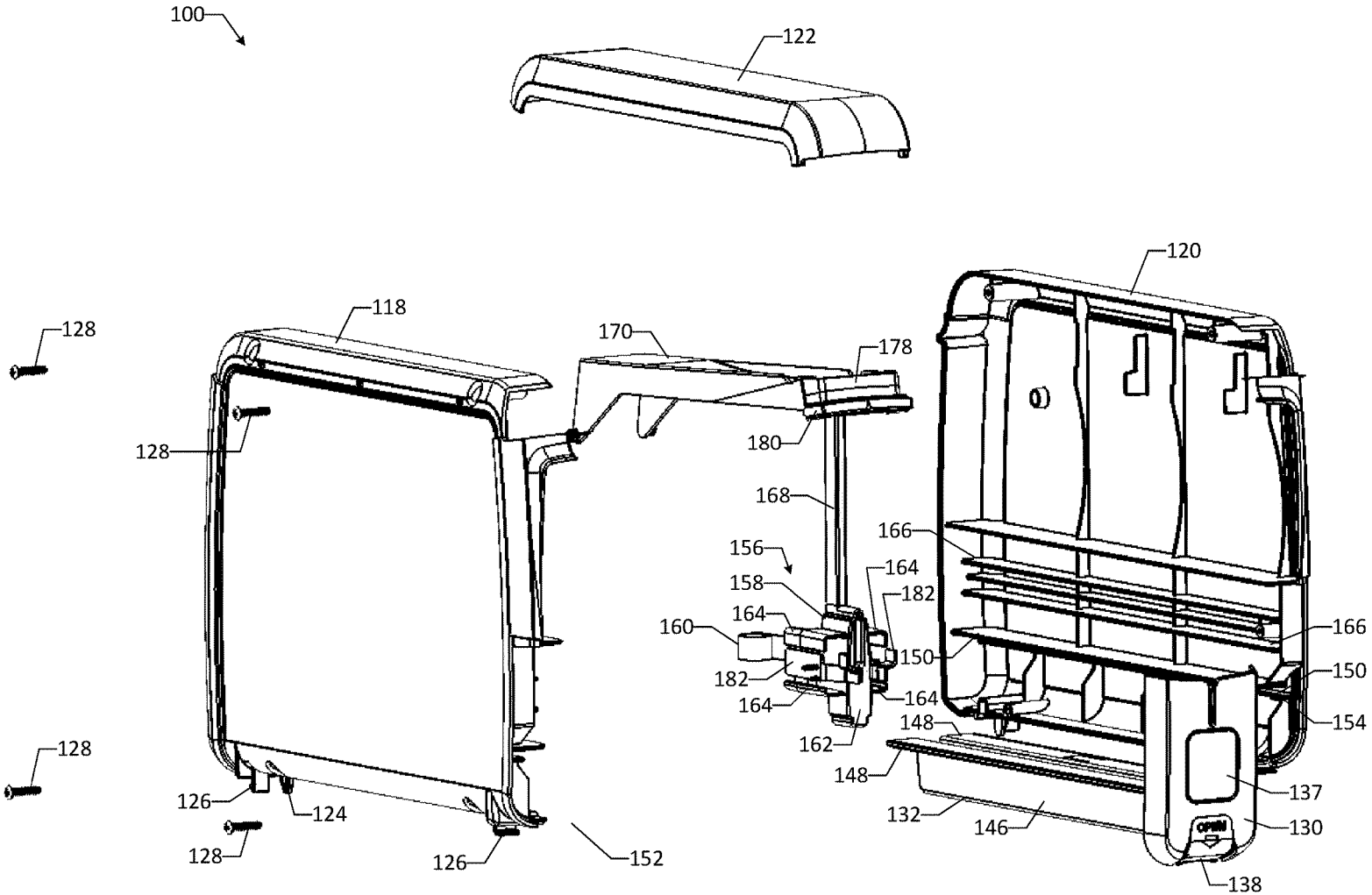
FIG. 1D is a partially-exploded perspective view of the cutlery dispenser of FIG. 1A.
Figure 1F:
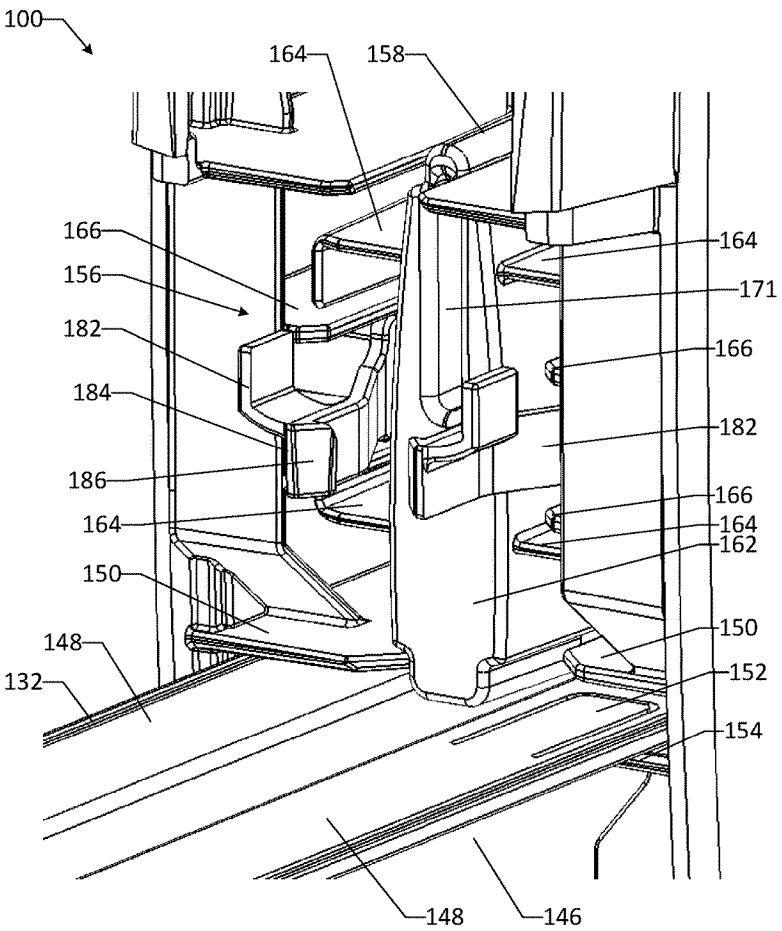
FIG. 1F is a detailed perspective view of a portion of the cutlery dispenser of FIG. 1A, showing a pusher assembly and sweeper arms of the cutlery dispenser.

The present disclosure includes example embodiments of cutlery dispensers and related methods for dispensing cutlery utensils to address one or more of the concerns discussed above. Reference is made herein to the accompanying drawings illustrating the example embodiments of the disclosure, in which use of the same reference numerals indicates similar or identical features or components. Throughout the disclosure, depending on the context, singular and plural terminology may be used interchangeably.

Figure 1E:
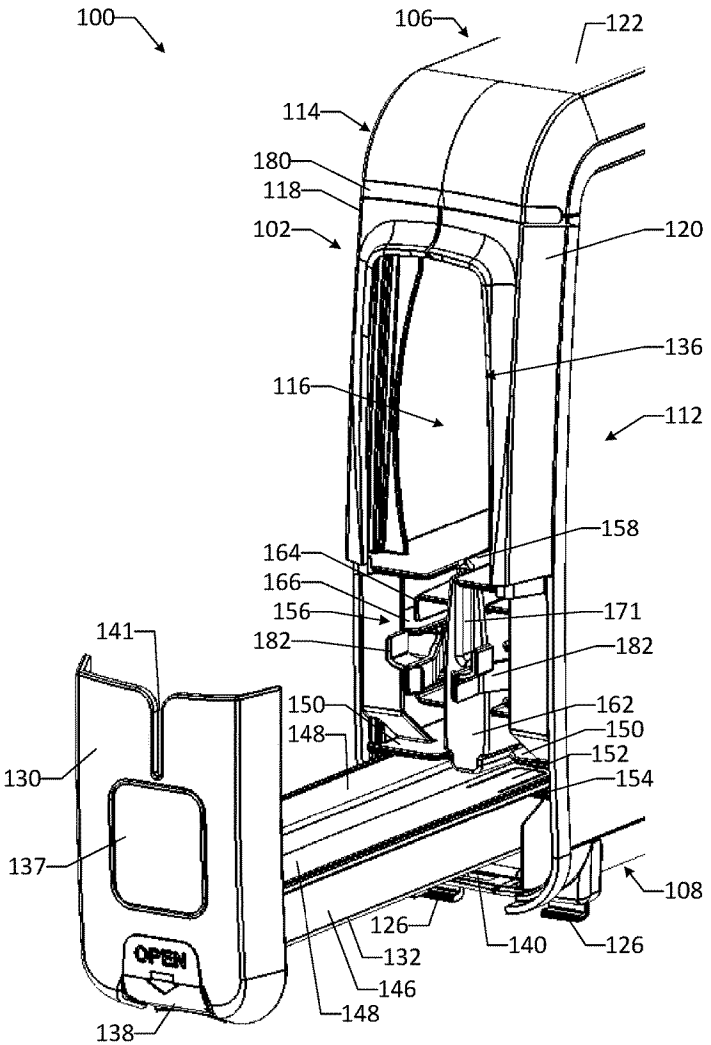
FIG. 1E is a perspective view of a portion of the cutlery dispenser of FIG. 1A, showing a front cover of the cutlery dispenser in an open position.
Figure 1G:
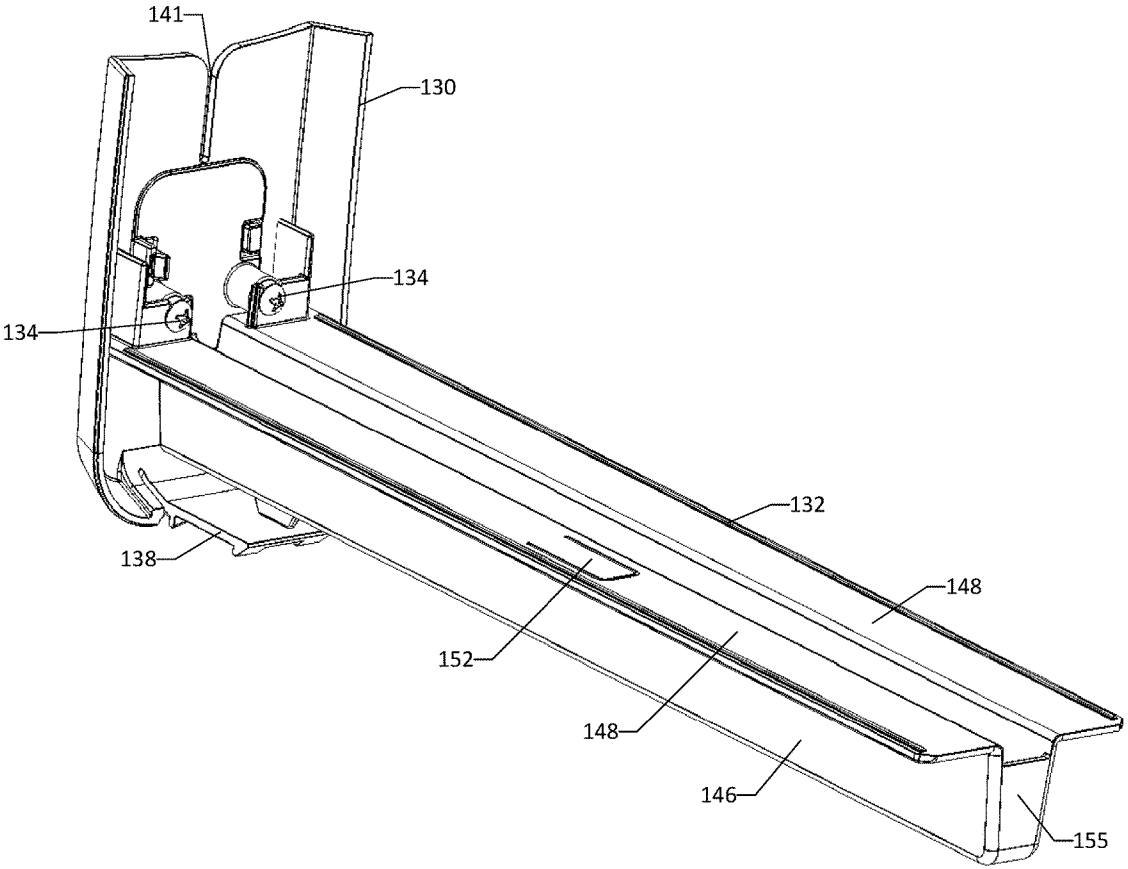
FIG. 1G is a perspective view of the front cover and a trough of the cutlery dispenser of FIG. 1A.
Figure 1H:
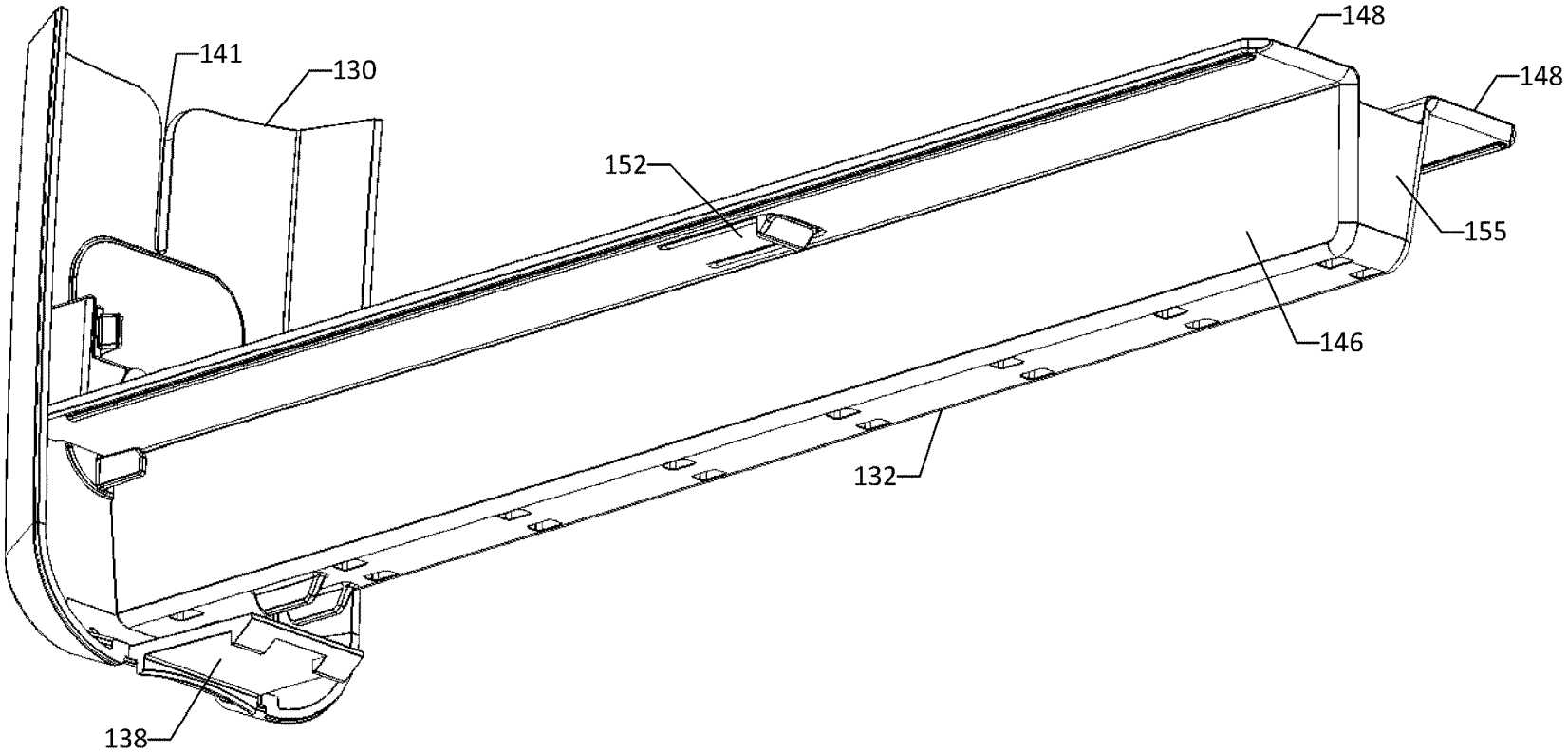
FIG. 1H is a perspective view of the front cover and the trough of the cutlery dispenser of FIG. 1A.
Figure 1J:
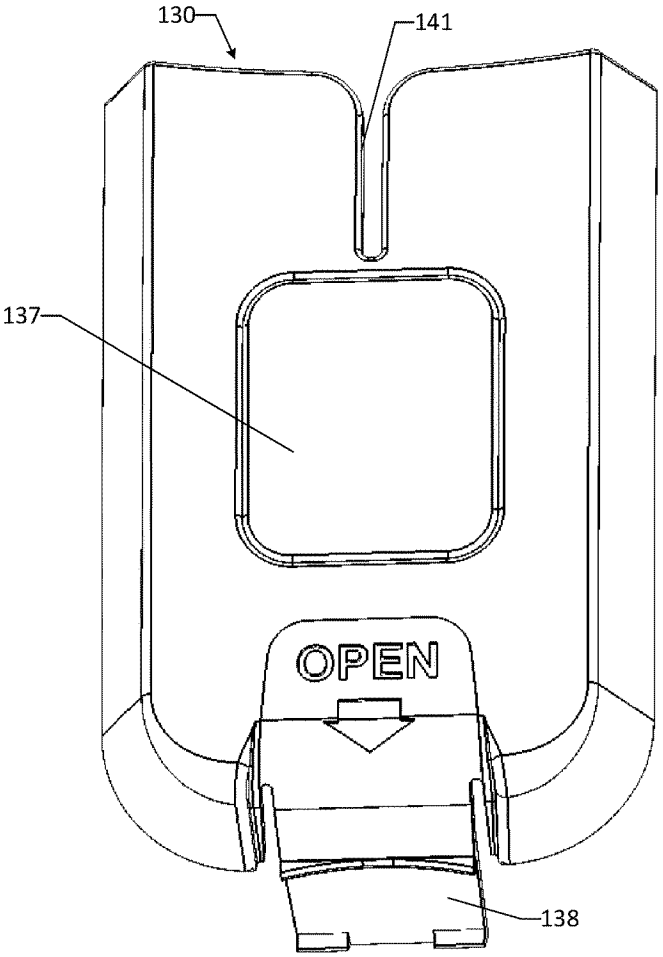
FIG. 1J is a perspective view of the front cover of the cutlery dispenser of FIG. 1A.
Figure 1I:
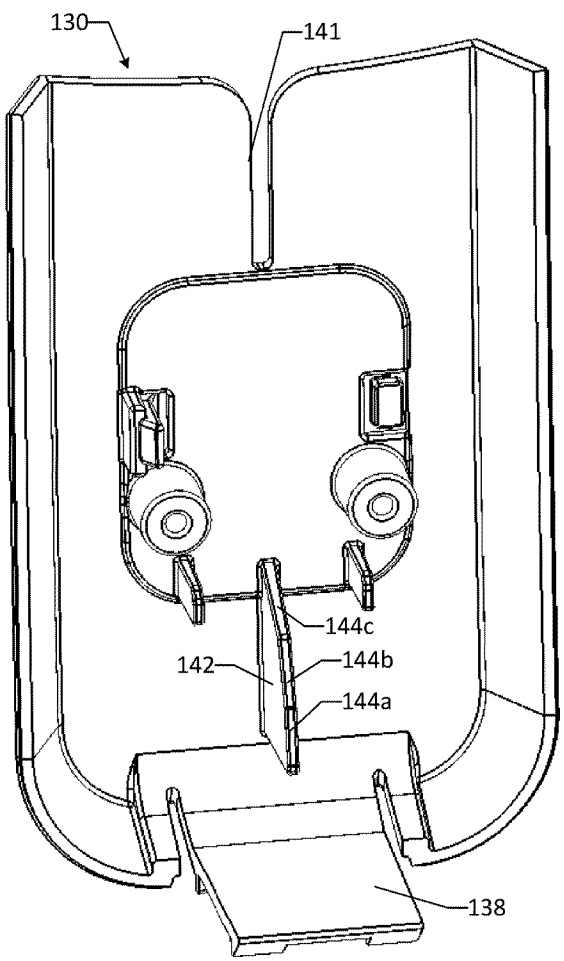
FIG. 1I is a perspective view of the front cover of the cutlery dispenser of FIG. 1A.
Figure 1L:
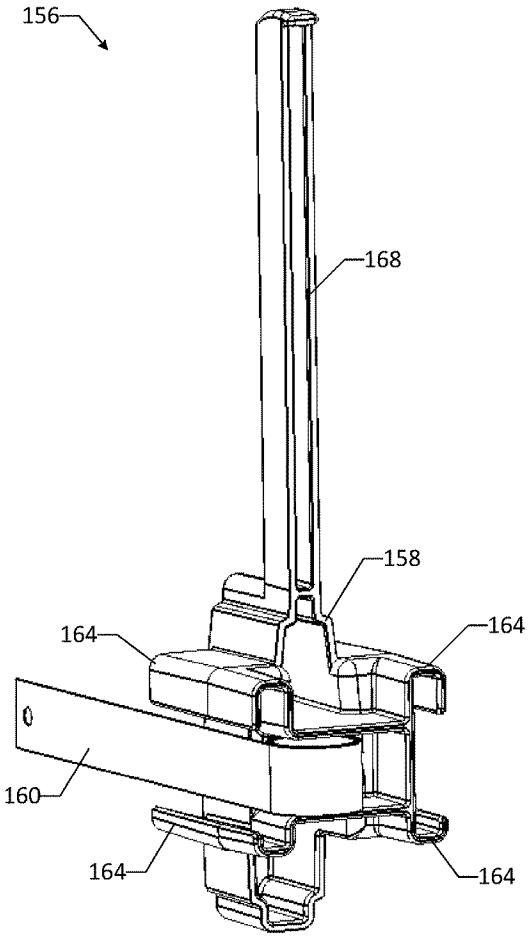
FIG. 1L is a perspective view of the pusher assembly of the cutlery dispenser of FIG. 1A.
Figure 1K:
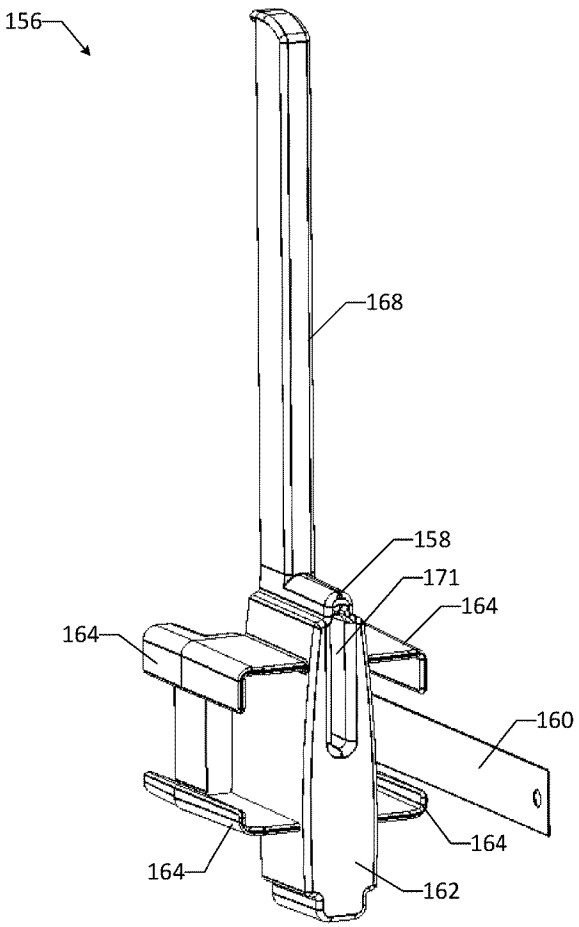
FIG. 1K is a perspective view of the pusher assembly of the cutlery dispenser of FIG. 1A.
Figure 1M:
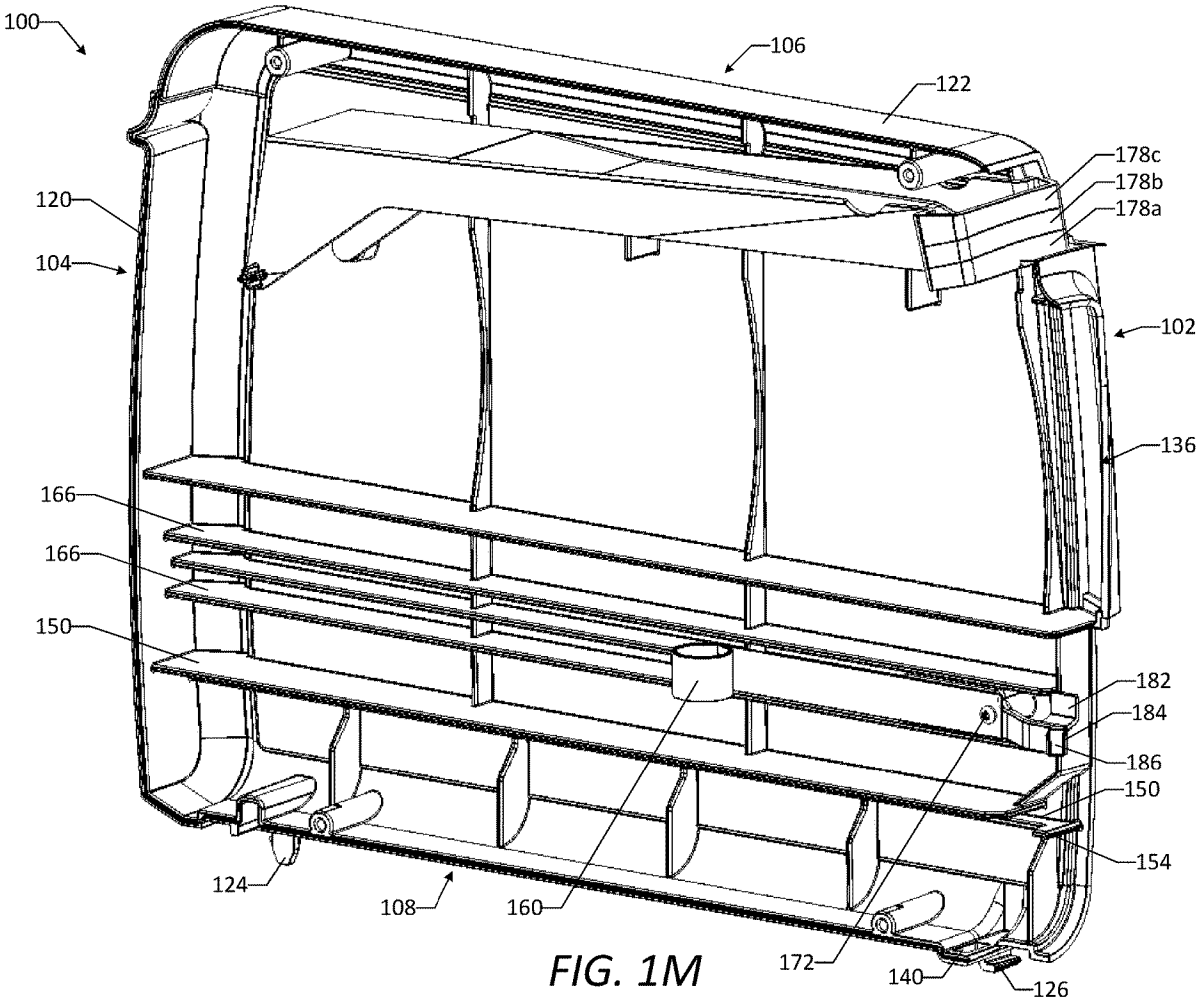
FIG. 1M is a perspective view of a portion of the cutlery dispenser of FIG. 1A, showing a housing portion, a follower arm, a sweeper arm, and a biasing member of the cutlery dispenser.
Figure 1O:
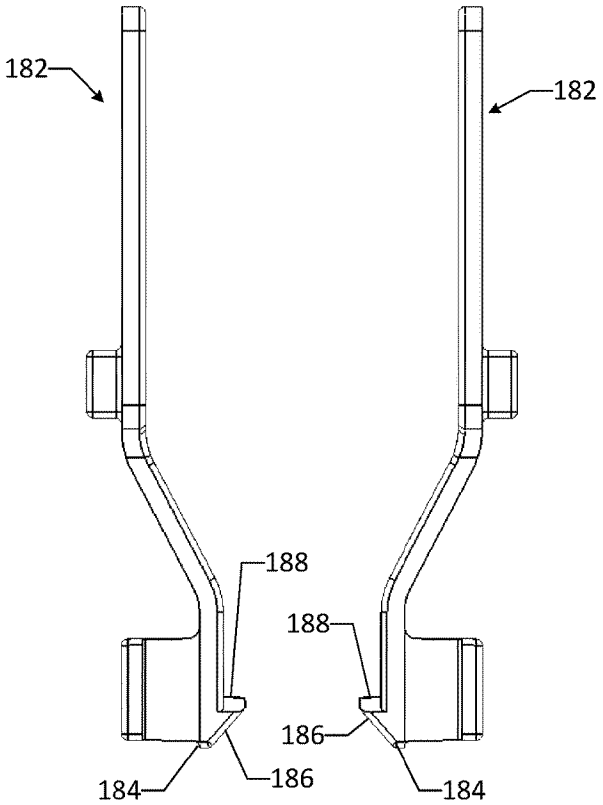
FIG. 1O is a top view of the sweeper arms of the cutlery dispenser of FIG. 1A.
Figure 1N:
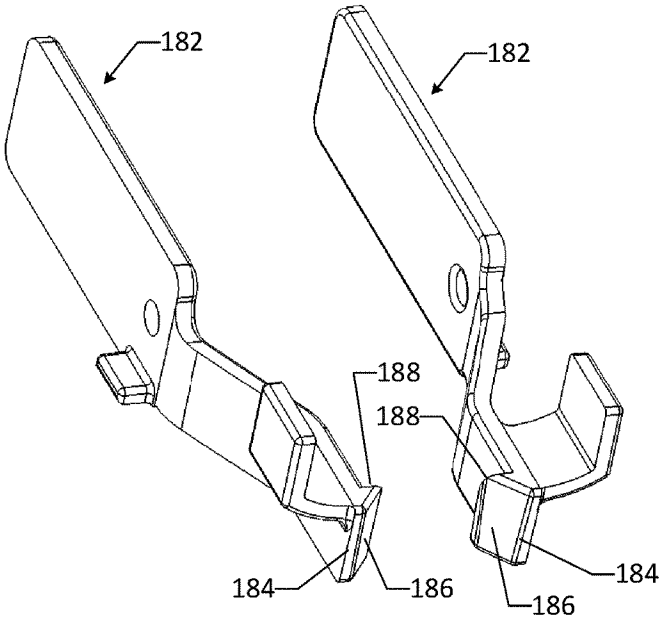
FIG. 1N is a perspective view of the sweeper arms of the cutlery dispenser of FIG. 1A.
Figure 1P:
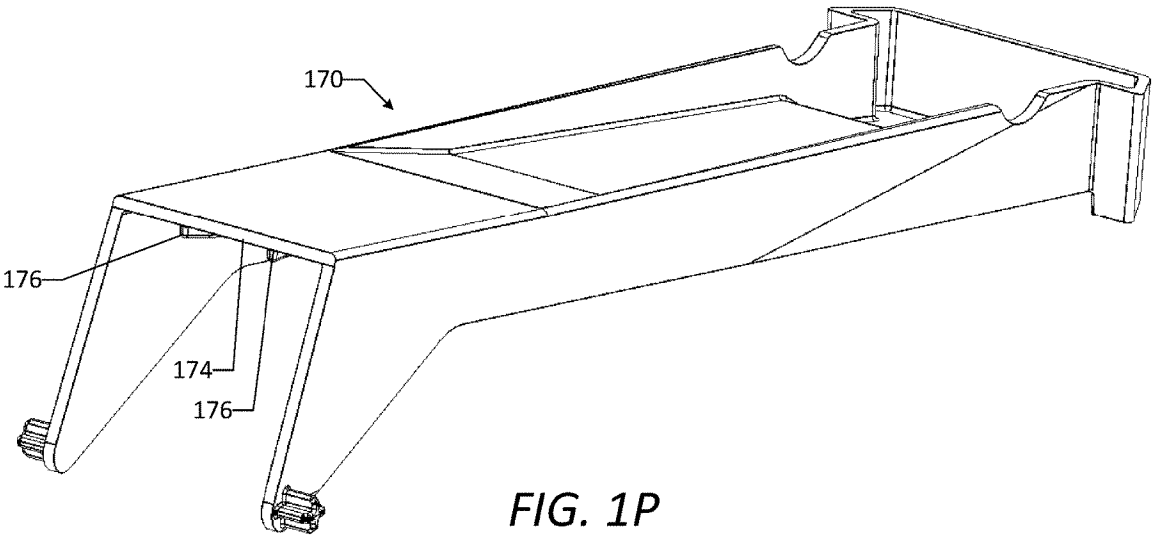
FIG. 1P is a perspective view of the follower arm of the cutlery dispenser of FIG. 1A.
Figure 1Q:
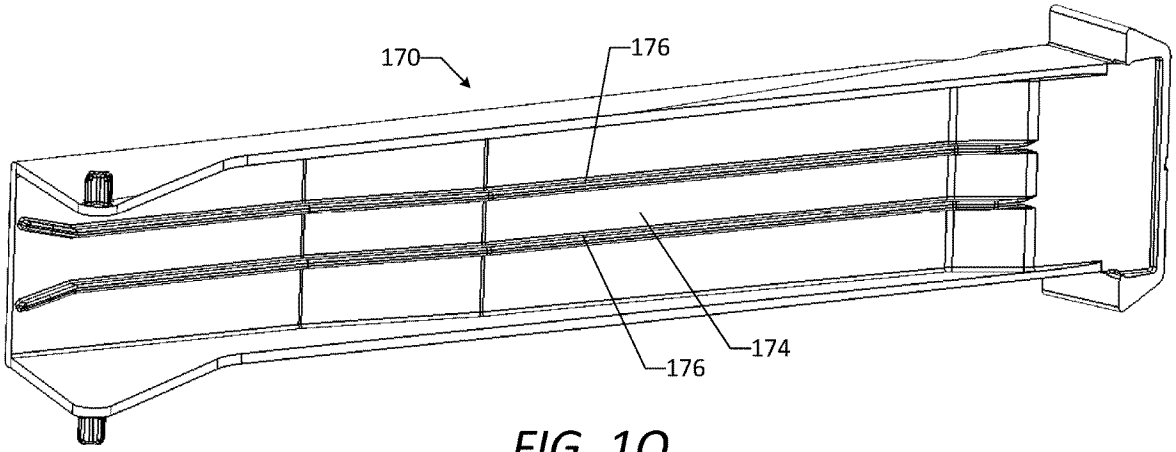
FIG. 1Q is a perspective view of the follower arm of the cutlery dispenser of FIG. 1A.
Figure 1R:
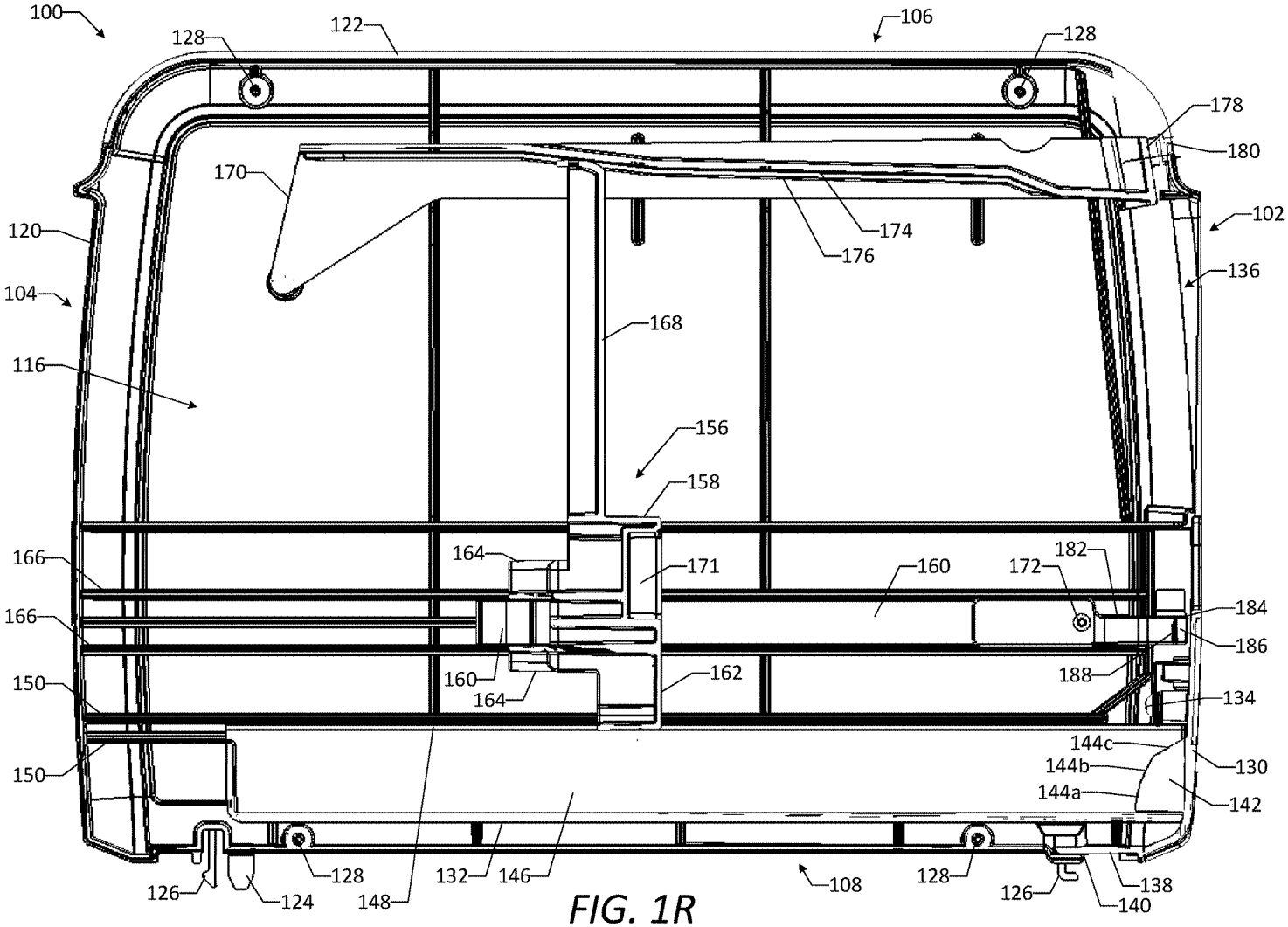
FIG. 1R is a cross-sectional side view of the cutlery dispenser of FIG. 1A, showing the pusher assembly in a rearward position relative to a housing of the cutlery dispenser.
Figure 1S:
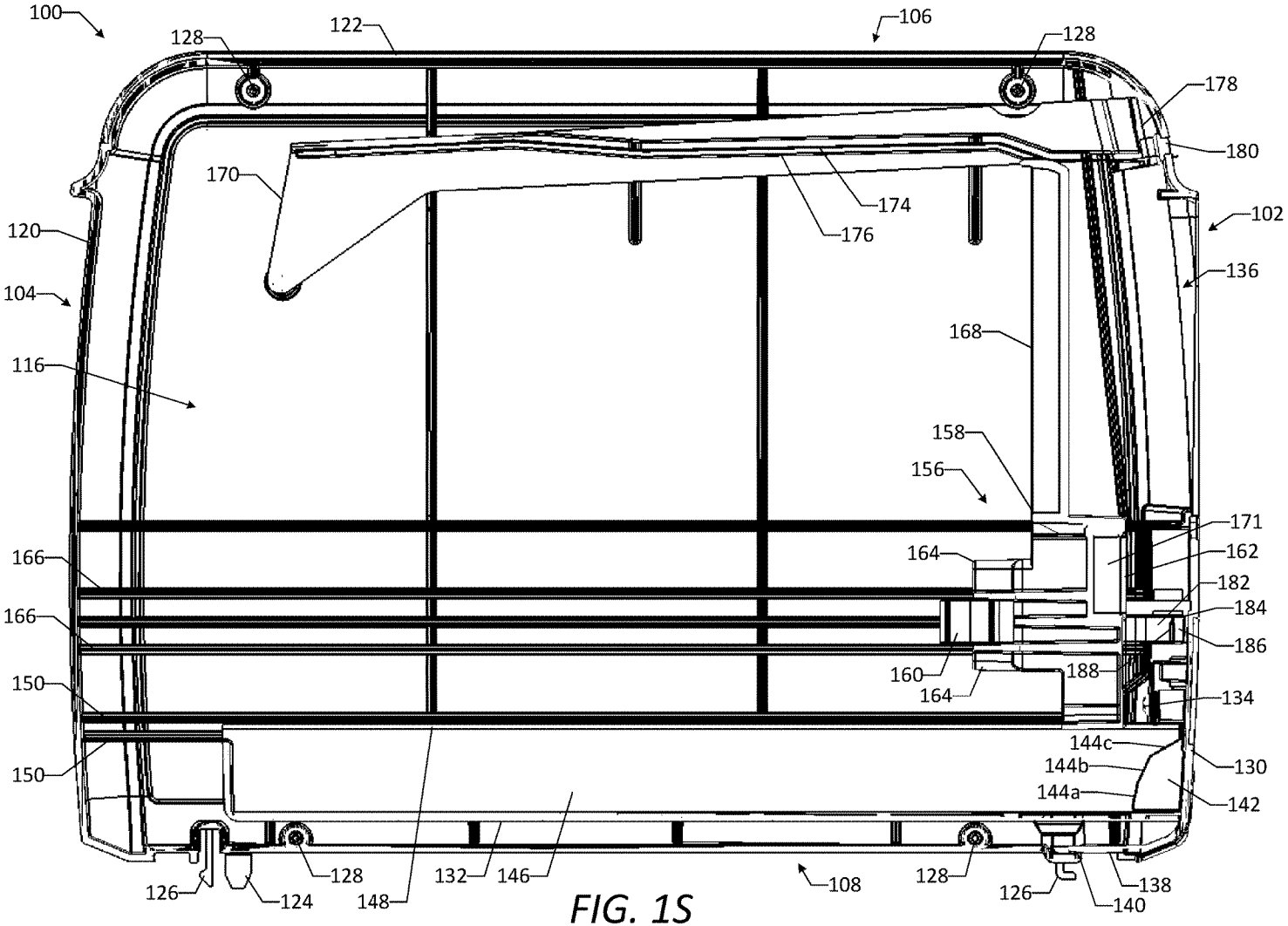
FIG. 1S is a cross-sectional side view of the cutlery dispenser of FIG. 1A, showing the pusher assembly in a forward position relative to the housing.

Referring now to the drawings, FIGS. 1A-1S show an example embodiment of a cutlery dispenser 100 as may be described herein. The cutlery dispenser 100 may have a generally rectangular shape configured to be oriented in an upright manner, as shown in FIG. 1A, although other suitable shapes and configurations of the cutlery dispenser 100 may be used in other embodiments. During use, the cutlery dispenser 100 may be oriented in the upright manner and positioned on a countertop or other support surface in a particular working environment, such as a restaurant, although other suitable orientations and positions of the cutlery dispenser 100 may be used. In certain embodiments, the cutlery dispenser 100 may be configured to be free-standing and portable, such that the cutlery dispenser 100 may be placed on any countertop or other support surface and may be easily moved from one position to another position thereon. In other embodiments, the cutlery dispenser 100 may be configured to be temporarily or permanently mounted and fixed to a countertop or other support surface. For example, the cutlery dispenser 100 may be mounted to a base or other support structure to securely maintain a desired orientation and position of the cutlery dispenser 100 with respect to the countertop or other support structure.

As described in detail below, the cutlery dispenser 100 may be configured to dispense a number of cutlery utensils 200 therefrom one at a time on demand. FIGS. 2A and 2B show an example cutlery utensil 200 that may be used with the cutlery dispenser 100. Although the cutlery utensil 200 is shown as a fork in FIGS. 2A and 2B, the utensil 200 may be any type of cutlery utensil, including, for example, a fork, a spoon, a knife, or a spork. In certain embodiments, the cutlery utensil 200 may be disposable and may be constructed of a moldable material, although other suitable materials may be used. The moldable material may include a plastic, a combination of plastics, or other materials suitable for use in forming cutlery utensils. For example, the moldable material may include one or more of polystyrene, polyethylene, and polypropylene. For instance, in certain embodiments, the cutlery utensil 200 may be constructed of recyclable and/or compostable materials.

As shown in FIGS. 2A and 2B, the cutlery utensil 200 may include a functional head 202, a handle 204, and a neck 206. The functional head 202 may extend from a first end of the cutlery utensil 200 and may be configured to perform a function to assist a user in the consumption of food. For example, the functional head 202 may be configured to cut, pierce, and/or scoop certain types of food for consumption. The handle 204 may extend from an opposite second end of the cutlery utensil 200 and may be configured to be grasped by the user for holding and/or manipulating the utensil 200. The neck 204 may be positioned between and connect the functional head 202 and the handle 204 and may provide a smooth transition therebetween. In certain embodiments, the cutlery utensil 200 may not include the neck 206, such that the handle 204 is connected to and extends directly from the functional head 202. The cutlery utensil 200 may be shaped and contoured as shown in FIGS. 2A and 2B, although other shapes and contours of the utensil 200 may be used.

As shown, the cutlery utensil 200 may include a skewer aperture 208 extending therethrough from a front surface 210 to a back surface 212 of the utensil 200. The skewer aperture 208 may be configured to receive a skewer 240 or other type of joinder member or loading member therethrough to facilitate loading of a number of the cutlery utensils 200 into the cutlery dispenser 100, as described below. In certain embodiments, as shown, the skewer aperture 208 may be defined in the handle 204 of the cutlery utensil 200 and spaced apart from the second end of the utensil 200, although other suitable locations of the skewer aperture 220 may be used. The skewer aperture 208 may have an elongated shape having a length extending along the length of the cutlery utensil 200 and a width extending along the width of the cutlery utensil 200. In certain embodiments, as shown, the skewer aperture 208 may have an elongated racetrack shape having rounded ends, although other shapes of the skewer aperture 208 may be used.

As shown in FIG. 2B, a thickness T of the handle 204 of the cutlery utensil 200 may vary along the length of the handle 204. The handle 204 may include a first portion 214 having a constant or substantially constant thickness T along the length of the first portion 214, and a second portion 216 having a varying thickness T along the length of the second portion 216. In certain embodiments, as shown, the front and back surfaces of the handle 204 may be parallel or substantially parallel to one another along the length of the first portion 214, and the front and back surfaces of the handle 204 may be oriented at an acute angle $\alpha$ relative to one another along the length of the second portion 216. As described in detail below, the angled shape of the second portion 216 may assist in allowing a number of the cutlery utensils 200 to be fanned when positioned within the cutlery dispenser 100, which may allow a user to easily grasp and dispense a leading cutlery utensil 200. The acute angle $\alpha$ between the front and back surfaces of the handle 204 along the second portion may be between one (1) degree and forty-five (45) degrees, between one (1) degree and thirty (30) degrees, between one (1) degree and twenty (20) degrees, between one (1) degree and ten (10) degrees, or between one (1) degree and six (6) degrees, depending on the degree of fanning desired, although other values of the acute angle $\alpha$ may be used. It will be appreciated that various types and configurations of cutlery utensils other than the type and configuration of the cutlery utensil 200 shown in FIGS. 2A and 2B may be used with the cutlery dispenser 100.

Figure 2D:
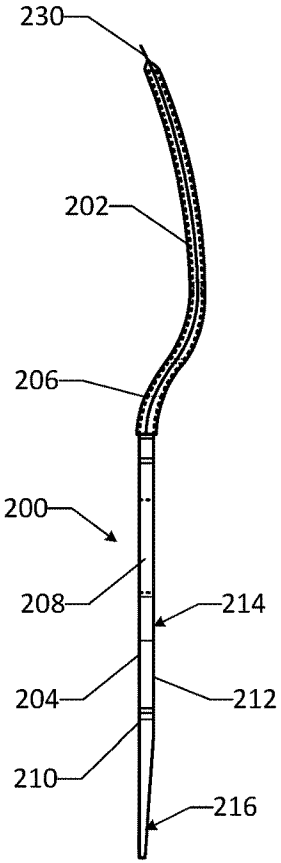
FIG. 2D is a side view of the cutlery utensil of FIG. 2A, with the wrapper enclosing the functional head of the cutlery utensil.
Figure 2C:
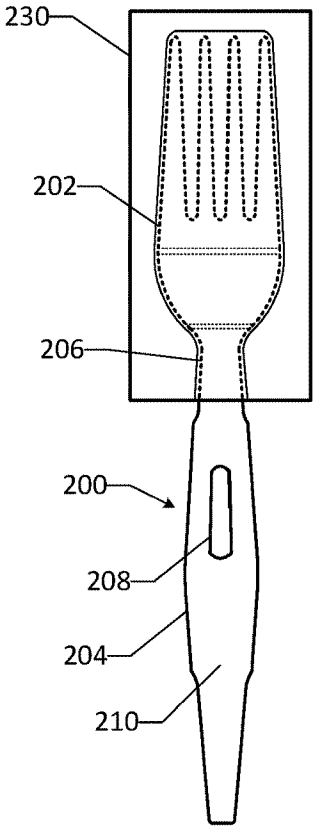
FIG. 2C is a front view of the cutlery utensil of FIG. 2A, with a wrapper enclosing a functional head of the cutlery utensil.
Figure 2B:
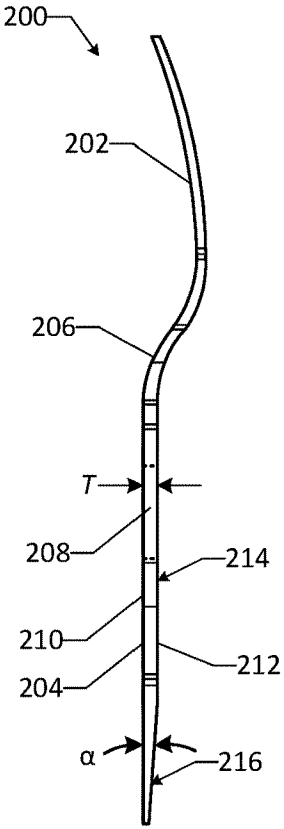
FIG. 2B is a side view of the cutlery utensil of FIG. 2A.
Figure 2A:
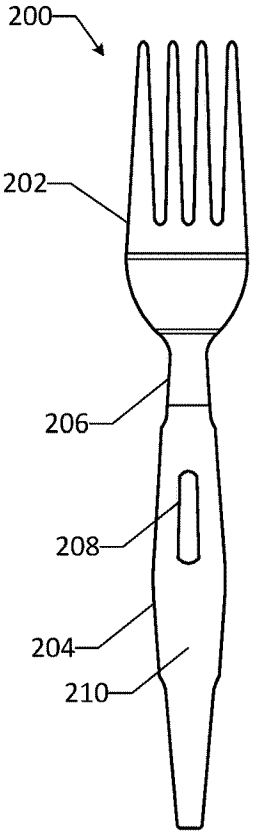
FIG. 2A is a front view of a cutlery utensil that may be used with the cutlery dispenser of FIG. 1A.

In certain embodiments, as shown in FIGS. 2C and 2D, a wrapper 230 may enclose at least a portion of the cutlery utensil 200. For example, according to the illustrated embodiment, the wrapper 230 may enclose the functional head 202 and at least a portion of the neck 206 of the cutlery utensil 200. In other embodiments, the wrapper 230 may enclose only the functional head 202 or at least an end portion thereof. In still other embodiments, the wrapper 230 may enclose the entire cutlery utensil 200. By enclosing a portion of the cutlery utensil 200, the wrapper 230 may protect the enclosed portion of the utensil 200 from contamination prior to and during dispensing of the utensil 200 from the cutlery dispenser 100. It will be appreciated that in those embodiments in which the wrapper 230 encloses the entire cutlery utensil 200 or at least covers the portion about the skewer aperture 208, the wrapper 230 will include a corresponding aperture (not shown) therein so as to allow a skewer or the like to pass therethrough. The wrapper 230 may be constructed of a thin layer of disposable packaging material, which may be at least substantially sealed to contain the enclosed portion of the cutlery utensil 200 therein. In certain embodiments, the wrapper 230 may be constructed of a plastic, including, for example, polyethylene, and the sealed portions of the wrapper 230 may be formed by heat sealing or glue sealing the plastic around the enclosed portion of the cutlery utensil 200. Other suitable materials of construction may be used to form the wrapper 230, and other suitable methods of forming the sealed regions may be used. It is also contemplated that each of the cutlery utensil embodiments contemplated by the present invention may be wrapper free. In other words, the cutlery dispenser 100 may be used to dispense a cutlery utensil 200 that does not have a wrapper 230 enclosing any portion of the utensil 200.

Figure 2G:
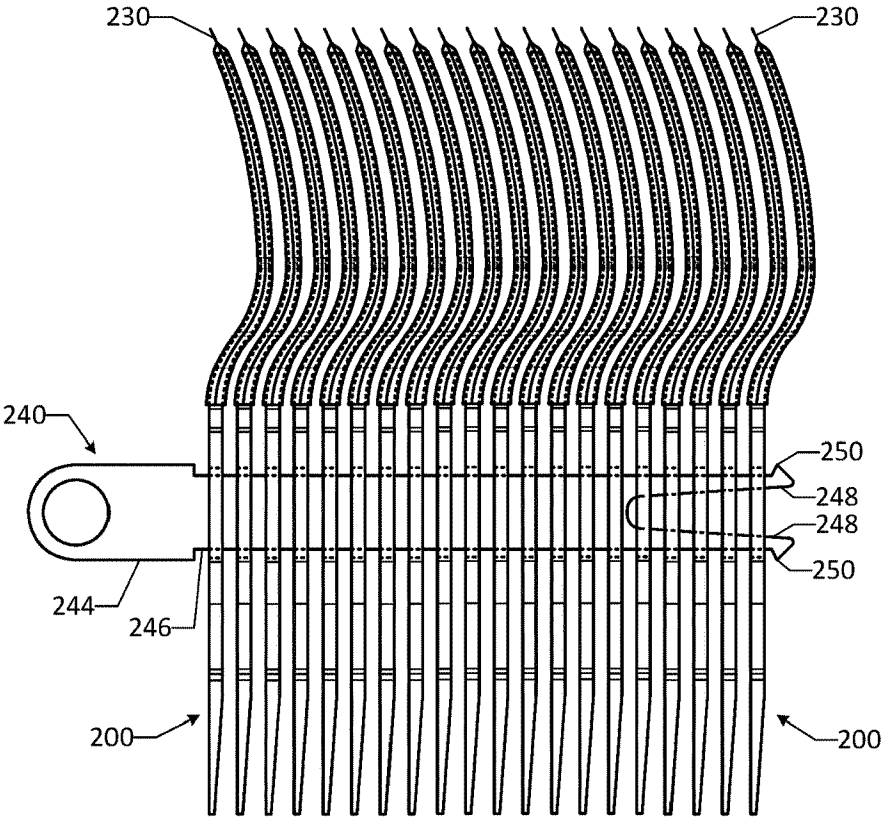
FIG. 2G is a side view of a number of the cutlery utensils of FIG. 2A and the skewer of FIG. 2E, showing the skewer extending through skewer apertures of the cutlery utensils to maintain the cutlery utensils in a stack.
Figure 2F:
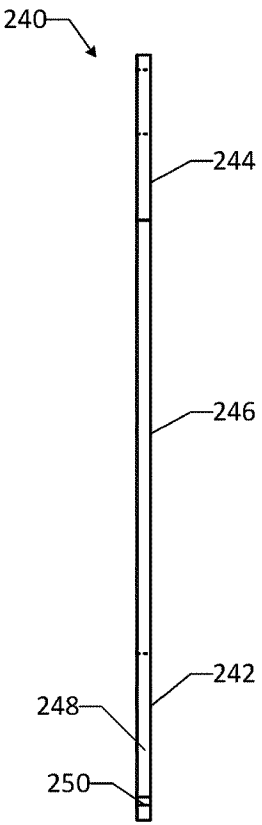
FIG. 2F is a top view of the skewer of FIG. 2E.
Figure 2E:
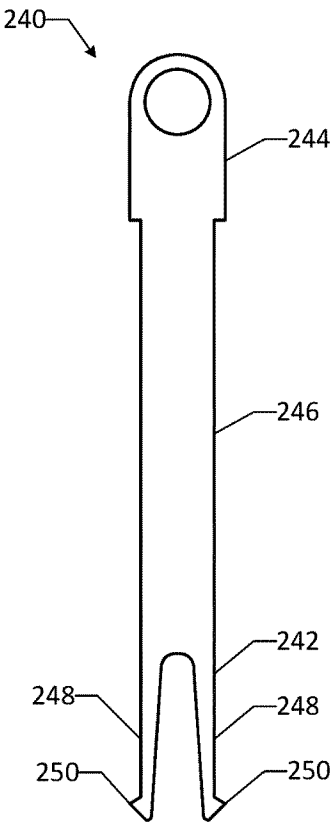
FIG. 2E is a side view of a skewer that may be used with a number of the cutlery utensils of FIG. 2A and the cutlery dispenser of FIG. 1A.

FIGS. 2E and 2F show an example skewer 240 that may be used with a number of the cutlery utensils 200 and the cutlery dispenser 100 to facilitate loading of the utensils 200 into the dispenser 100 and/or unloading of the utensils 200 from the dispenser 100. As shown, the skewer 240 may have an elongated shape and may include a retainer head 242, a handle 244, and a shank 246. The retainer head 242 may extend from a first end of the skewer 240 and may be configured to be inserted through the skewer apertures 208 of the cutlery utensils 200 and to releasably retain the utensils 200 on the skewer 240. In certain embodiments, as shown, the retainer head 242 may include a pair of retainer arms 248 spaced apart from one another and configured to deflect towards one another when the retainer head 242 is inserted through the skewer aperture 208 of the cutlery utensil 200. Each retainer arm 248 may include a barb 250 positioned at or near the free end of the retainer arm 248 and configured to releasably retain the cutlery utensil 200 on the skewer 240 when the retainer head 242 is inserted within the skewer aperture 208 of the utensil 200. The handle 244 may extend from an opposite second end of the skewer 240 and may be configured to be grasped by a user for holding and/or manipulating the skewer 240. As shown, the cross-sectional shape of the handle 244 may be larger than the cross-sectional shape of the skewer aperture 208 of the cutlery utensil 200, such that the handle 244 is prevented from being inserted into the skewer aperture 208. The shank 246 may be positioned between and connect the retainer head 242 and the handle 244 and may be configured to be inserted through the skewer apertures 208 of the cutlery utensils 200. The skewer 240 may be shaped and contoured as shown in FIGS. 2E and 2F, although other shapes and contours of the utensil 200 may be used. It will be appreciated that various configurations of the skewer 240 or other joinder members may be used with the cutlery utensils 200 and the cutlery dispenser 100. For example, the skewer 240 may have a more complex configuration than the illustrated embodiment and/or may include multiple components configured to interact with the cutlery utensils 200 and the cutlery dispenser 100.

FIG. 2G shows the skewer 240 with a number of the cutlery utensils 200 positioned thereon in a stack, such that the utensils 200 are arranged in a nested manner. Although twenty (20) cutlery utensils 200 are shown positioned on the skewer 240 in the illustrated embodiment, the skewer 240 may be configured to retain any suitable number of cutlery utensils 200. As shown, the skewer 240 may be inserted through the skewer apertures 208 of the cutlery utensils 200, such that the shank 246 and at least a portion of the retainer head 242 are positioned therethrough and the retainer arms 248 retain the cutlery utensils 200 on the skewer 240. The corresponding cross-sectional shapes of the shank 246 and the skewer apertures 208 may prevent or restrict the cutlery utensils 200 from rotating relative to the skewer 240, such that all of the cutlery utensils 200 are retained in a common orientation. The cutlery utensils 200 may be loaded onto the skewer 240 by inserting the retainer head 242 through the skewer apertures 208 of the utensils 200 and advancing the utensils along the shank 246 toward the handle 244. As the barbs 250 pass through each skewer aperture 208, the retainer arms 248 may deflect towards one another and then assume their relaxed state after the barbs 250 pass through the skewer aperture 208. In this manner, the cutlery utensils 200 may be retained on the shank 246 and/or the retainer head 242 of the skewer 240. The cutlery utensils 200 may be removed from the skewer 240 by restraining the relative position of the utensils 200, for example by one or more components of the cutlery dispenser 100 contacting one or more of the utensils 200, and pulling the handle 244 of the skewer 240 away from the utensils 200. In particular, the handle 244 may be pulled with sufficient force to cause the retainer arms 248 to deflect towards one another such that the barbs 250 may pass through the skewer apertures 208 of the utensils 200. In this manner, the cutlery utensils 200 may be removed from the shank 246 and the retainer head 242 of the skewer 240. As described in detail below, the skewer 240 may be used to load the stack of the cutlery utensils 200 into the cutlery dispenser 100 in an easy and efficient manner. The skewer 240 also may be used to unload a number of the cutlery utensils 200 from the cutlery dispenser 100 in an opposite manner, as described below.

Referring back to FIGS. 1A-1D, the cutlery dispenser 100 may have a front 102, a back 104, a top 106, a bottom 108, a first side 110, and a second side 112. It will be appreciated that the nomenclature associated with these sides of the cutlery dispenser 100 are with respect to the upright orientation shown in FIGS. 1A-1D, and that the dispenser 100 may be used in other orientations. As shown, the cutlery dispenser 100 may include a housing 114 that includes a number of walls and defines an interior space 116 therein, inward from the walls of the housing 114. The interior space 116 may be configured to receive a number of the cutlery utensils 200 therein and to contain various components of the cutlery dispenser 100 therein. In certain embodiments, as shown, the housing 114 may include a number of portions that are separately formed and attached to one another. For example, the housing 114 may include a first housing portion 118, a second housing portion 120, and a top cover 122 that are separately formed and attached to one another. In certain embodiments, the first housing portion 118 and the second housing portion 120 may be mirror images or substantially mirror images of one another. As shown, the first housing portion 118 may define at least a portion of each of the front 102, the back 104, the top 106, the bottom 108, and the first side 110 of the cutlery dispenser 100, and the second housing portion 120 may define at least a portion of each of the front 102, the back 104, the top 106, the bottom 108, and the second side 112 of the cutlery dispenser 100. The first housing portion 118 and the second housing portion 120 each may include one or more feet 124 or other leveling features positioned along the bottom thereof and configured to support the cutlery dispenser 100 on a countertop or other support surface in the upright orientation. Additionally or alternatively, the first housing portion 118 and the second housing portion 120 each may include one or more mounting tabs 126 positioned along the bottom surface thereof and configured to securely engage mating receptacles of a base or platform on which the cutlery dispenser 100 may be mounted. For example, the mounting tabs 126 may be configured to form a snap fit with the mating receptacles to securely mount the cutlery dispenser 100 to the base or platform. In certain embodiments, as shown, the first housing portion 118 and the second housing portion 120 may be securely attached to one another by one or more fasteners 128, such as screws, although other attachment mechanisms may be used. The top cover 122 may be positioned over and attached to each of the first housing portion 118 and the second housing portion 120. As shown, the top cover 122 may define at least a portion of each of the front 102, the back 104, the top 106, the first side 110, and the second side 112 of the cutlery dispenser 100. The housing 114 may be constructed of any suitable type of substantially rigid material including thermoplastics, such as polypropylene, metals, such as aluminum, composite materials, or other suitable materials. It will be appreciated that various shapes and configurations of the housing 114 may be used with the cutlery dispenser 100.

The cutlery dispenser 100 also may include a front cover 130 and a trough 132 attached to the front cover 130. In some embodiments, as shown, the front cover 130 and the trough 132 may be separately formed and attached to one another. For example, the front cover 130 and the trough 132 may be attached to one another by one or more fasteners 134, such as screws, although other attachment mechanisms may be used. In other embodiments, the front cover 130 and the trough 132 may be integrally formed with one another as a single component. The front cover 130 and the trough 132 may be configured to move relative to the housing 114 between a closed position, as shown in FIG. 1A, for dispensing of the cutlery utensils 200 from the cutlery dispenser 100, and an open position, as shown in FIG. 1E, for loading the cutlery utensils 200 into the interior space 116 of the dispenser 100. In particular, the front cover 130 and the trough 132 may be configured to slide or translate relative to the housing 114 between the closed position and an open position. It will be appreciated that the front cover 130 and the trough 132 may have a number of open positions, depending on the extent to which the front cover 130 and the trough 132 are moved relative to the housing 114. When the front cover 130 and the trough 132 are in the closed position, the front cover 130 may partially enclose the interior space 116, such that a dispensing opening 136 of the cutlery dispenser 100 is defined between respective portions of the front cover 130 and the housing 114. As described below, a leading cutlery utensil 200 (i.e., the cutlery utensil 200 positioned closest to the dispensing opening 136 and within the interior space 116 of the housing 114) may extend through the dispensing opening 136, such that a user may grasp and remove the leading cutlery utensil 200 through the dispensing opening 136. As shown, the front cover 130 may be positioned along a bottom portion of the front 102 of the cutlery dispenser 100, and the dispensing opening 136 may be positioned along a top portion of the front 102 of the dispenser 100, although other positions of the front cover 130 and the dispensing opening 136 may be used.

In certain embodiments, as shown, the front cover 130 may include an indicator portion 137 positioned along the front of the cover 130 and visible to a user. The indicator portion 137 may include an indicator, such as a symbol, a word, or a braille pattern, which indicates the type of cutlery utensil 200 contained within the cutlery dispenser 100 and/or provides a decorative feature for branding or marketing purposes. In certain embodiments, as shown, the indicator portion 137 may be removably attached to a remainder of the front cover 130, for example by a snap-fit connection. In this manner, the indicator portion 137 may be removed and replaced with a different indicator portion 137 when the type of cutlery utensil 200 to be dispensed from the dispenser 100 is changed. As shown, the front cover 130 may include a locking tab 138, which may be positioned along the bottom of the front cover 130 and may be configured to releasably engage a locking receptacle 140 defined in the housing 114 when the front cover 130 is in the closed position. In this manner, the locking tab 138 and the locking receptacle 140 may form a releasable lock to prevent the front cover 130 from inadvertently moving from the closed position to an open position. The locking tab 138 may be disengaged from the locking receptacle 140 by deflecting the locking tab 138 away from the locking receptacle 140, thereby allowing the front cover 130 to be moved to an open position. The front cover 130 also may include a skewer slot 141 defined therein and configured to allow a portion of the skewer 240 to be received within the slot 141. As described below, the skewer slot 141 may facilitate alignment of the skewer 420 relative to the front cover 130 and the overall cutlery dispenser 100 during loading of the cutlery utensils 200 into the dispenser 100 via the skewer 240. In certain embodiments, as shown, the skewer slot 141 may extend vertically from the top of the front cover 130, although other orientations and positions of the skewer slot 141 may be used.

The front cover 130 also may include a wedge protrusion 142 positioned along the vertical interior surface of the front cover 130 and extending inward therefrom. As described in detail below, the wedge protrusion 142 may be configured to engage a portion of the leading cutlery utensil 200, such as a portion of the handle 204 of the leading cutlery utensil 200, such that the leading cutlery utensil 200 is tilted forward (i.e., toward the front 102 of the dispenser 100) from an upright position to a tilted position and a portion of the leading cutlery utensil 200, such as the functional head 202 of the leading cutlery utensil 200, extends at least partially through the dispensing opening 136 and outside of the interior space 116. In this manner, the wedge protrusion 142 may cause the leading cutlery utensil 200 and a number of subsequent cutlery utensils 200 (i.e., cutlery utensils 200 positioned further from the dispensing opening 136 than the leading cutlery utensil 200) to assume a fanned arrangement, with the functional heads 202 of these utensils 200 spaced apart from one another to facilitate dispensing. As shown, the wedge protrusion 142 may include one or more contact surfaces 144 configured to engage the front surface of the handle 204 of the leading cutlery utensil 200 such that the leading cutlery utensil 200 is tilted from the upright position to the tilted position. According to the illustrated embodiment, the wedge protrusion 142 may include three (3) contact surfaces 144, although any suitable number of contact surfaces 144 may be used. In particular, the wedge protrusion 142 may include a bottom contact surface 144*a*, an intermediate contact surface 144*b*, and a top contact surface 144*c*. As shown, each of the contact surfaces 144 may be oriented at an acute angle relative to the vertical interior surface of the front cover 130. In certain embodiments, the acute angle of the bottom contact surface 144*a* may be less than the acute angle of the intermediate contact surface 144*b*, and the acute angle of the intermediate contact surface 144*b* may be less than the acute angle of the top contact surface 144*c*, although other configurations of the contact surfaces 144 may be used. According to the illustrated embodiment, each of the contact surfaces 144 may be a planar surface. In other embodiments, one or more of the contact surfaces 144 may be a curved surface or otherwise may be contoured to have a non-planar shape. Although the wedge protrusion 142 is shown as being part of the front cover 130, the wedge protrusion 142 alternatively may be part of the trough 132.

As shown, the trough 132 may extend inward from the front cover 130 and may move therewith when the front cover 130 is moved between the closed position and an open position. The trough 132 may have an elongated shape and may include a base 146 having a U-shaped cross-sectional shape, and a pair of flanges 148 extending laterally from the base 146. The base 146 may be configured to receive a portion of each of the cutlery utensils 200 in the cutlery dispenser 100. In particular, according to the illustrated embodiment, the base 146 may be configured to receive a portion of the handle 204 of each of the cutlery utensils 200 therein. In other embodiments, the base 146 may be configured to receive a portion of the functional head 202 of each of the cutlery utensils 200 therein. As shown, each of the flanges 148 may be movably received between a pair of guide rails 150 of the housing 114. In this manner, the guide rails 150 may guide the sliding horizontal movement of the trough 132 relative to the housing 114 and may prevent or restrict vertical movement of the trough 132 relative to the housing 114. As shown in FIGS. 1G and 1H, the trough 132 may include a stop tab 152 configured to engage a stop protrusion 154 of the housing 114 to limit the sliding movement of the trough 132 relative to the housing 114. In certain embodiments, the stop tab 152 may be positioned on one of the flanges 148 of the trough 132, although other positions of the stop tab 152 may be used. The stop tab 152 effectively may define a fully open position of the front cover 130 and the trough 132 relative to the housing 114. In this manner, the stop tab 152 may prevent or restrict the trough 132 from being completely removed from the interior space 116 of the housing 114. As shown, the trough 132 also may include a stop wall 155 positioned at or near the end of the trough 132 opposite the front cover 130 and extending vertically along the height of the base 146. The stop wall 155 effectively may limit the number of the cutlery utensils 200 that may be positioned within the trough 132. In particular, the stop wall 155 may be configured to engage a trailing cutlery utensil 200 (i.e., the cutlery utensil 200 positioned furthest from the dispensing opening 136) when the cutlery dispenser 100 is at a maximum fill level. In this manner, the stop wall 155 may prevent overloading of cutlery utensils 200 in the cutlery dispenser 100, which might otherwise result in jamming of the dispenser 100 and/or subjecting one or more components of the dispenser 100 to undesirable stresses.

The cutlery dispenser 100 also may include a pushing assembly 156 movably positioned within the interior space 116 of the dispenser 100 and configured to push or advance the cutlery utensils 200 toward the front 102 of the dispenser 100. As shown in FIGS. 1K-1L, the pusher assembly 156 may include a support member 158 and one or more biasing members 160. The support member 158 may be configured to translate or slide relative to the housing 114 in a direction extending from the front 102 of the dispenser 100 to the back 104 of the dispenser 100, and the biasing member 160 may be configured to bias the support member 158 toward the front 102 of the dispenser 100 and into engagement with the trailing cutlery utensil 200 loaded in the dispenser 100. As shown, the support member 158 may include a contact surface 162 positioned along the front of the support member 158 and configured to engage the back surface of the trailing cutlery utensil 200. The support member 158 also may include a number of arms 164 extending laterally and configured to movably engage respective guide rails 166 of the housing 114. In this manner, the guide rails 166 may guide the sliding horizontal movement of the support member 158 relative to the housing 114 and may prevent or restrict vertical movement of the support member 158 relative to the housing 114. The support member 158 also may include a guide post 168 extending vertically upward and configured to movably engage a follower arm 170 of the cutlery dispenser 100. As shown, the support member 158 may include a skewer opening 171 defined in the front of the support member 158 and configured to receive a portion of the skewer 240 therein during loading of the cutlery utensils 200 into the dispenser 100. In particular, the skewer opening 171 may facilitate alignment of the skewer 240 and the cutlery utensils 200 positioned thereon with respect to the dispenser 100 during loading the utensils 200, as described below. The biasing member 160 may be securely attached to the housing 114, for example by a fastener 172, such as a screw, and may be configured to engage a back surface of the support member 158. In this manner, the biasing member 160 may bias the support member 158 toward the front 102 of the dispenser 100 and into engagement with the trailing cutlery utensil 200. In certain embodiments, as shown, the biasing member 160 may be a constant force spring, although other types of springs or biasing members may be used.

As shown, the follower arm 170 may positioned within a top portion of the interior space 116 of the housing 114 and may be pivotally attached to the housing 114. In this manner, the follower arm 170 may pivot relative to the housing 114 during use of the dispenser 100. As shown in FIGS. 1P and 1Q, the follower arm 170 may include a contact surface 174 positioned along the bottom of the follower arm 170 and configured to engage the guide post 168 of the support member 158. The contact surface 174 may be contoured as shown, such that the follower arm 170 pivots relative to the housing 114 when the support member 158 translates relative to the housing 114. In particular, as shown in FIGS. 1R and 1S, the follower arm 170 may pivot upward relative to the housing 114 when the support member 158 translates toward the front 102 of the cutlery dispenser 100. As shown, the follower arm 170 may include a pair of guide ribs 176 extending along the contact surface 174 and spaced apart from one another to guide the support member 158 as the follower arm 170 and the support member 158 move relative to the housing 114. As shown in FIG. 1M, the follower arm 170 may include a number of indicators 178 configured to indicate a fill level of the cutlery utensils 200 loaded within the interior space 116 of the cutlery dispenser 100 and/or to indicate whether additional cutlery utensils 200 may be loaded into the interior space 116 of the dispenser 100. In certain embodiments, as shown, the follower arm 170 may include three (3) indicators 178, although any number of the indicators 178 may be used. A first indicator 178*a* may indicate that the dispenser 100 is full or nearly full, a second indicator 178*b* may indicate that the dispenser 100 is partially full, and a third indicator 178*c* may indicate that the dispenser 100 is empty or nearly empty. In certain embodiments, the indicators 178 may be colored-coded, with each indicator 178 being a different color. For example, the first indicator 178*a* may be green, the second indicator 178*b* may be yellow, and the third indicator 178*c* may be red, although other colors may be used for the indicators 178. In certain embodiments, the indicators 178 may indicate whether an additional stack of the cutlery utensils 200 (i.e., the number of the cutlery utensils 200 that may be loaded on the skewer 240 at once) may be loaded into the dispenser 100. For example, the first indicator 178*a* may indicate that no additional full stacks of the utensils 200 may be loaded into the dispenser 100, the second indicator 178*b* may indicate that one additional stack of the utensils 200 may be loaded into the dispenser 100, and the third indicator 178*c* may indicate that two additional stacks of the utensils 200 may be loaded into the dispenser 100. It will be understood that the indicators 178 may provide any type of visual indication, such as colors, symbols, numbers, or words. During use of the cutlery dispenser 100, one of the indicators 178 may be visible through an indicator window 180 of the housing 114, while the remaining indicators 178 are hidden from view. Other configurations may allow for a transition between two of the indicators 178. In certain embodiments, as shown, the indicator window 180 may be positioned along the front 102 of the dispenser 100, although other positions of the indicator window 180, such as along the top 106 or one of the sides 110, 112 of the dispenser 100, may be used. As the follower arm 170 pivots relative to the housing 114, the indicator 178 that is visible through the indicator window 180 may allow a user to determine the fill level of the cutlery utensils 200 loaded within the interior space 116 of the cutlery dispenser 100 and/or whether additional utensils 200 may be loaded into the interior space 116 of the dispenser 100. Although the indicators 178 are shown as being part of the follower arm 170 in the illustrated embodiment, the indicators 178 alternatively may be part of the support member 158, and the indicator window 180 may be configured to allow the different indicators 178 to be viewed as the support member 158 translates relative to the housing 114.

The cutlery dispenser 100 also may include a pair of sweeper arms 182 securely attached to the housing 114 and configured to retain the cutlery utensils 200 within the interior space 116 of the housing 114 as the cutlery utensils 200 are loaded into the dispenser 100. In certain embodiments, the sweeper arms 182 may be attached to the housing 114 by one or more of the fasteners 172, although other attachment mechanisms may be used. The sweeper arms 182 may be spaced apart from and positioned opposite one another, such that the cutlery utensils 200 may be inserted therebetween. As shown in FIGS. 1N and 1O, each sweeper arm 182 may include a barb 184 positioned along a front end of the sweeper arm 182 and configured to engage the cutlery utensils 200. In particular, the barb 184 may include a lead-in surface 186 configured to engage the back surface of a cutlery utensil 200 as the utensil 200 is inserted between the sweeper arms 182, and a contact surface 188 configured to engage the front surface of the cutlery utensil 200 after the utensil 200 is inserted past the barb 184. The sweeper arms 182 may be spaced apart and configured to deflect away from one another when the cutlery utensil 200 engages the lead-in surfaces 186 and then return to their original, relaxed position after the utensil 200 is inserted past the barb 184. The cutlery utensil 200 subsequently may be biased into engagement with the contact surfaces 188 by the pushing assembly 156. As described below, the sweeper arms 182 may engage the leading cutlery utensil 200 and maintain the loaded cutlery utensils 200 within the interior space 116 of the dispenser 100 when the front cover 130 is in an open position and may disengage (i.e., be spaced apart from and not in contact with) the leading cutlery utensil 200 when the front cover 130 is in the closed position.

Figure 3A:
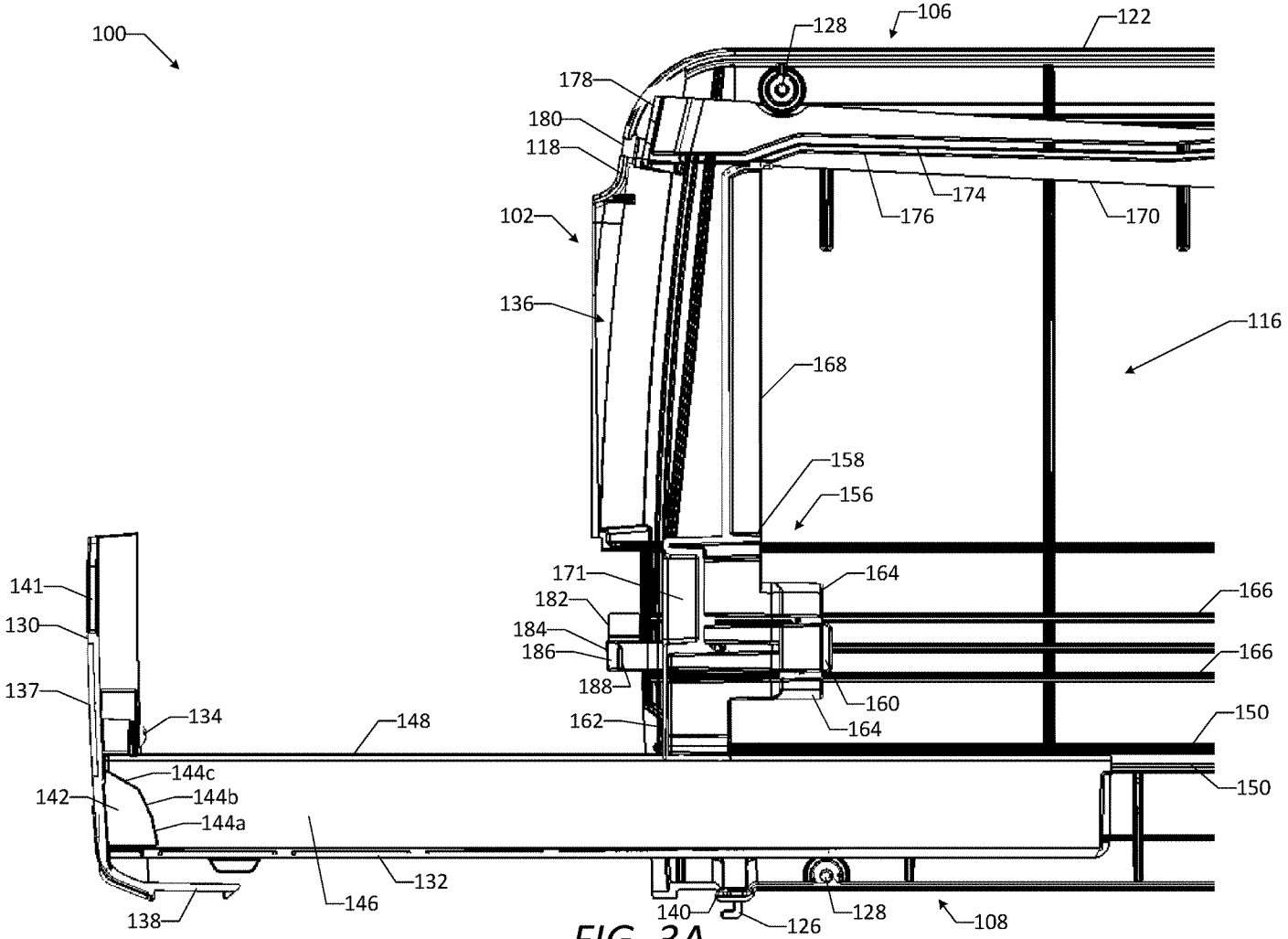
FIG. 3A is a cross-sectional side view of a portion of the cutlery dispenser of FIG. 1A, showing the front cover of the cutlery dispenser in an open position.
Figure 3B:
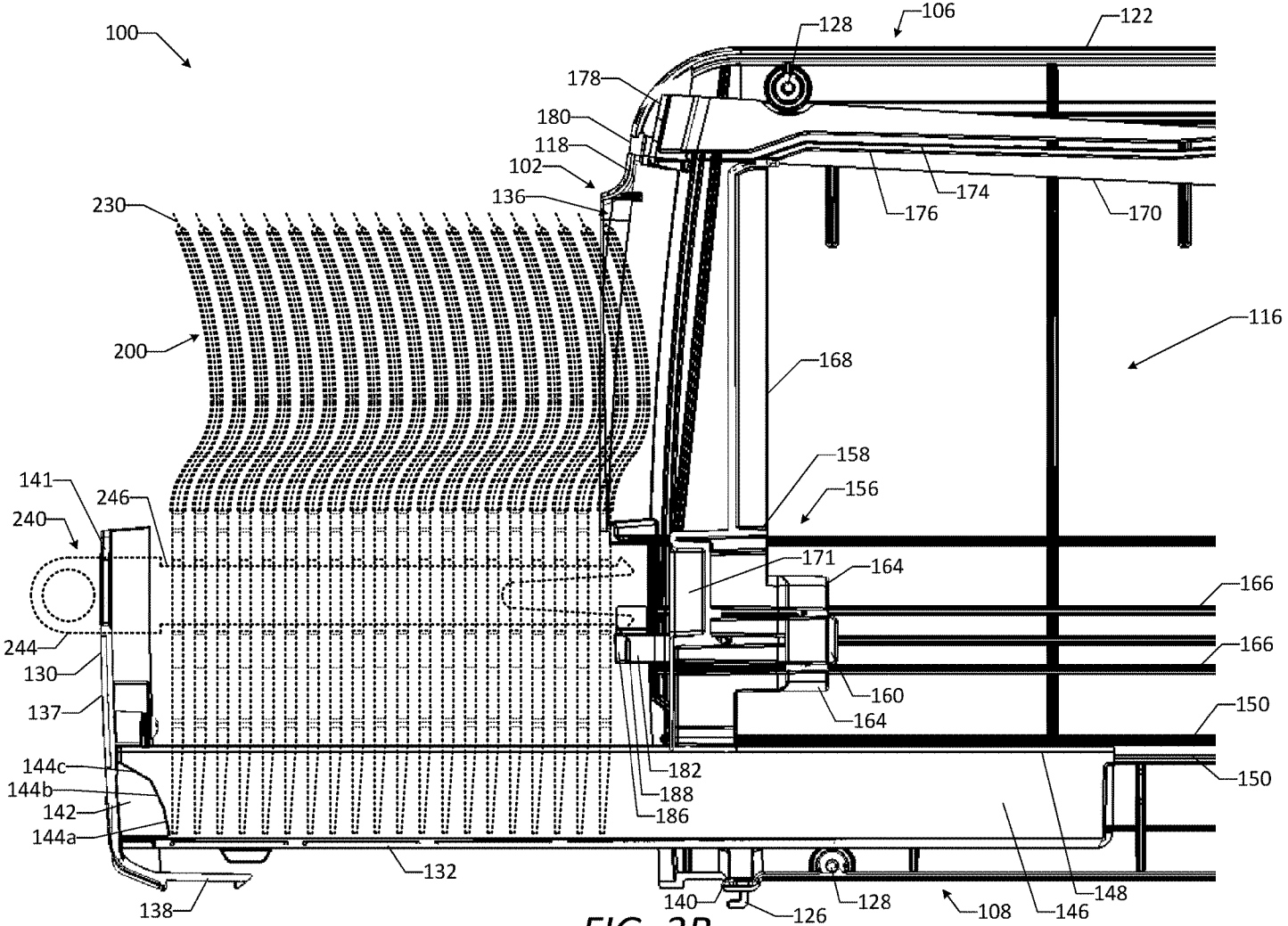
FIG. 3B is a cross-sectional side view of the cutlery dispenser of FIG. 1A, showing the front cover in an open position and a number of the cutlery utensils of FIG. 2A positioned on the skewer of FIG. 2E and partially within the trough of the cutlery dispenser.

FIGS. 3A-3D illustrate an example method of loading a number of the cutlery utensils 200 into the cutlery dispenser 100 and dispensing the loaded cutlery utensils 200 (i.e., the utensils 200 positioned within the interior space 116 of the housing 114) from the cutlery dispenser 100. The front cover 130 may be moved relative to the housing 114 from the closed position to an open position, as shown in FIG. 3A. In particular, the locking tab 138 of the front cover 130 may be depressed to disengage the locking receptacle 140 of the housing 114, and the front cover 130 may be pulled away from the front of the housing 114 along with the trough 132. As described above, the front cover 130 may be pulled until the stop tab 152 of the trough 132 engages the stop protrusion 154 of the housing 114, such that the front cover 130 and the trough 132 are in the fully open position, as shown. A number of the cutlery utensils 200, previously loaded on the skewer 240, then may be inserted between the front cover 130 and the pushing assembly 156 via the skewer 240 while the skewer 240 is received within and extends through the skewer slot 141 and the handle 244 of the skewer 240 remains at least partially in front of the front cover 130, as shown in FIG. 3B. In particular, the handles 204 of the cutlery utensils 200 may be inserted into the base 146 of the trough 132, as shown. In this manner, the cutlery utensils 200 may be oriented in an upright or substantially upright manner with the functional heads 202 of the utensils 200 positioned above the handles 204 of the utensils 200. This orientation of the cutlery utensils 200 advantageously may allow the cutlery dispenser 100 to receive and dispense any suitable type of utensil 200 (e.g., forks, spoons, knives, sporks, etc.) having a handle 204 configured to be received within the trough 132 and a body that is sized to functionally fit within the dispenser 100.

Figure 3C:
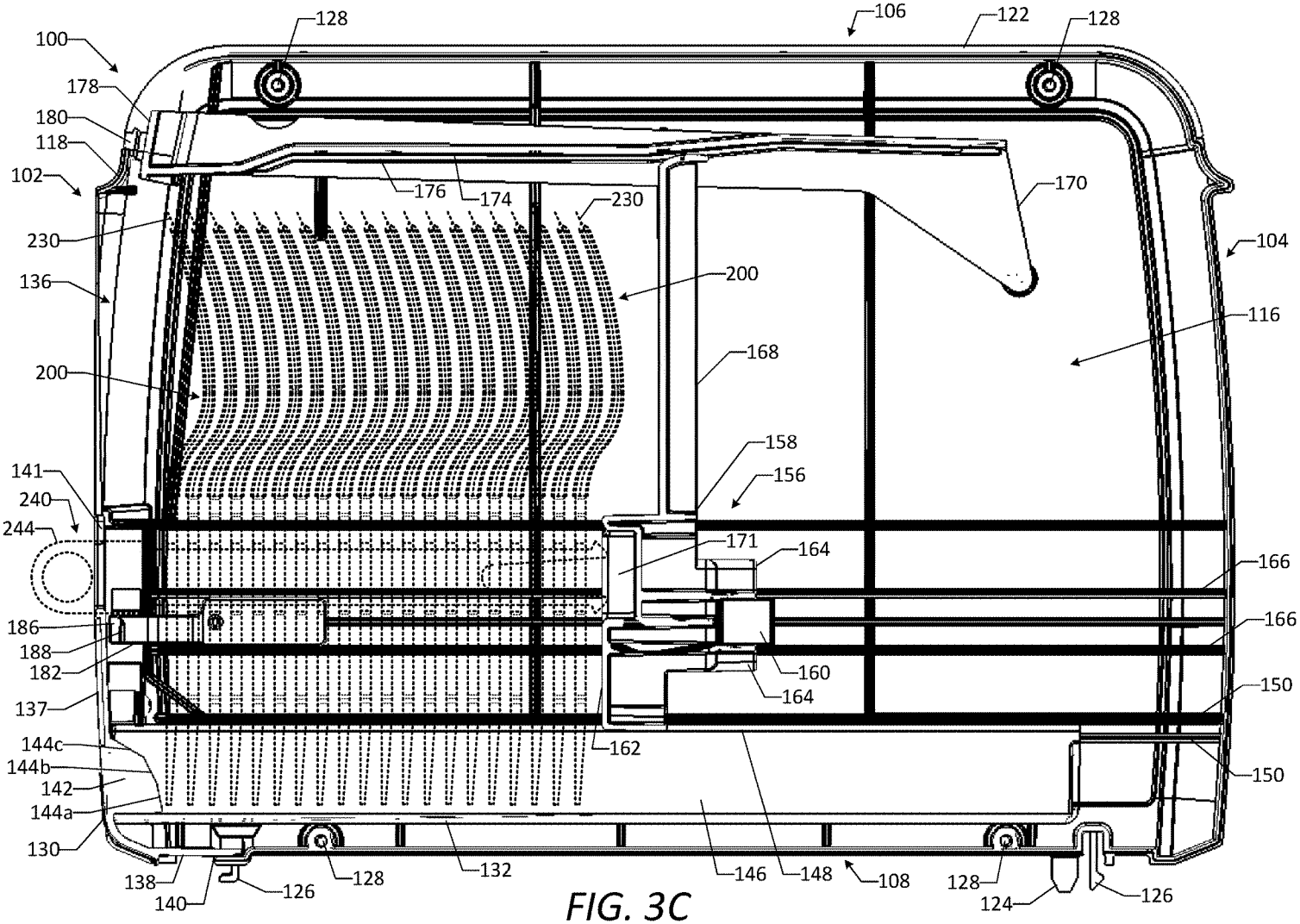
FIG. 3C is a cross-sectional side view of the cutlery dispenser of FIG. 1A, showing the front cover in a closed position and the number of the cutlery utensils of FIG. 2A positioned on the skewer of FIG. 2E and within an interior space of the housing of the cutlery dispenser.

After inserting the handles 204 of the cutlery utensils 200 into the trough 132, the front cover 130 and the trough 132 may be moved relative to the housing 114 from the open position to the closed position, as shown in FIG. 3C. As the front cover 130 is closed, the cutlery utensils 200 may pass between the sweeper arms 182 and into the interior space 116 of the dispenser 100, each utensil 200 engaging the lead-in surfaces 186 of the barbs 184 and deflecting the sweeper arms 182 away from one another as the utensil 200 is inserted therebetween. Additionally, as the front cover 130 is closed, the trailing cutlery utensil 200 should engage the contact surface 162 of the support member 158, thereby moving the support member 158 toward the back 104 of the dispenser 100 and unfurling the biasing member 160 toward the back 104 of the dispenser 100. The biasing member 160 may bias the support member 158 toward the front 102 of the dispenser 100 such that the contact surface 162 maintains engagement with the back surface of the trailing cutlery utensil 200. As the support member 158 moves toward the back 104 of the dispenser 100, the guide post 168 of the support member 158 may move along the contoured contact surface 174 of the follower arm 170 such that the follower arm 170 pivots upward relative to the housing 114 and the visible indicator 178 indicates the fill level of the cutlery utensils 200 loaded in the dispenser 100 or available capacity of the dispenser 100. When the front cover 130 and the trough 132 reach the closed position, the locking tab 138 of the front cover 130 may engage the locking receptacle 140 of the housing 114, thereby preventing the front cover 130 from being inadvertently moved toward an open position.

Figure 3D:
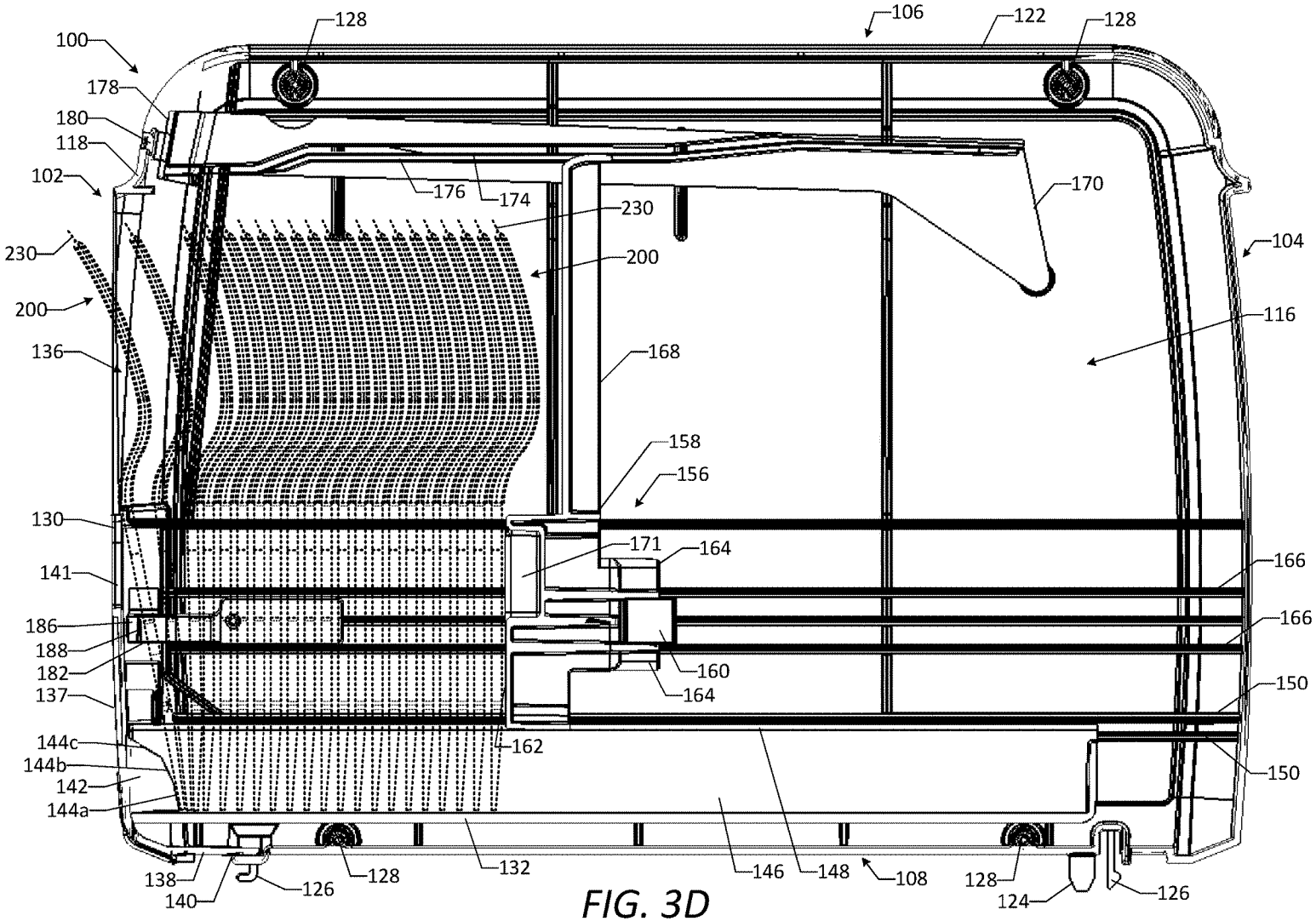
FIG. 3D is a cross-sectional side view of the cutlery dispenser of FIG. 1A, showing the front cover in the closed position and the number of the cutlery utensils of FIG. 2A positioned within the interior space.

After moving the front cover 130 and the trough 132 to the closed position, the skewer 240 may be removed from the skewer apertures 208 of the cutlery utensils 200, via the skewer slot 141 of the front cover 130, and from the overall cutlery dispenser 100. In particular, the skewer 240 may be removed from the skewer apertures 208 and the skewer slot 141 by pulling the skewer 240 away from the front cover 130, via the handle 244, while the cutlery utensils 200 are restrained by the sweeper arms 182 and/or the front cover 130. When the cover 130 is in the closed position and the skewer 240 is removed from the skewer apertures 208 and the skewer slot 141, the pushing assembly 156 may move the cutlery utensils 200 toward the front 102 of the dispenser 100 and into engagement with the wedge protrusion 142, as shown in FIG. 3D. In particular, the biasing member 160 is shown biasing the support member 158 against the trailing cutlery utensil 200 such that the cutlery utensils 200 are compressed together and the leading cutlery utensil 200 engages the wedge protrusion 142. As shown, the front surface of the handle 204 of the leading cutlery utensil 200 engages the wedge protrusion 142 such that the leading cutlery utensil 200 is tilted toward the front 102 of the dispenser 100 and at least a portion of the functional head 202 of the leading cutlery utensil 200 extends through the dispensing opening 136 and out of the dispenser 100. As shown, when the handle 204 of the leading cutlery utensil 200 engages the wedge protrusion 142, the handle 204 desirably is disengaged and spaced apart from the sweeper arms 182. In this manner, the handle 204 of the leading cutlery utensil 200 no longer engages the contact surfaces 188 of the sweeper arms 182 when the front cover 130 is closed. The angled shape of the wedge protrusion 142 and the angled shape of the second portions 216 of the cutlery utensils 200 may cause the leading cutlery utensil 200 and a number of the subsequent cutlery utensils 200 to assume a fanned arrangement, as shown in FIG. 3D, with portions of the handles 204 of such utensils 200 abutting one another and the functional heads 202 of such utensils 200 spaced apart from one another.

The fanned arrangement of the cutlery utensils 200 may allow a user to easily grasp and pull the functional head 202 of the leading cutlery utensil 200, such that the leading cutlery utensil 200 may be removed from the cutlery dispenser 100. When the leading cutlery utensil 200 is removed from the dispenser 100, the biasing member 160 may move the support member 158 toward the front 102 of the dispenser 100 such that the contact surface 162 of the support member 158 maintains engagement with the back surface of the trailing cutlery utensil 200 and all of the cutlery utensils 200 move into position for a subsequent dispense.

Figure 3E:
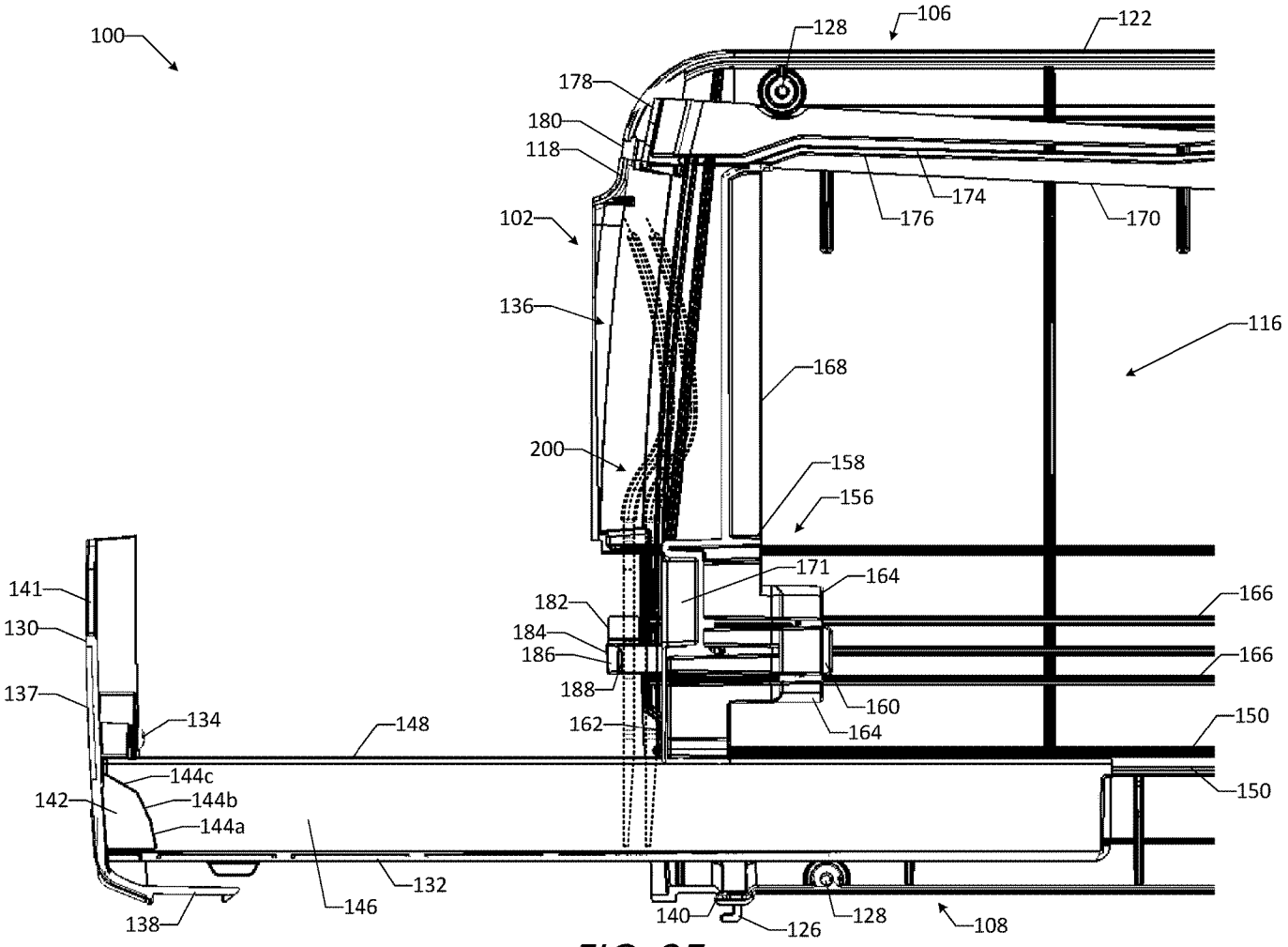
FIG. 3E is a cross-sectional side view of a portion of the cutlery dispenser of FIG. 1A, showing the front cover in an open position and a number of the cutlery utensils of FIG. 2A positioned within the interior space and retained therein by the sweeper arms of the cutlery dispenser.
Figure 3F:
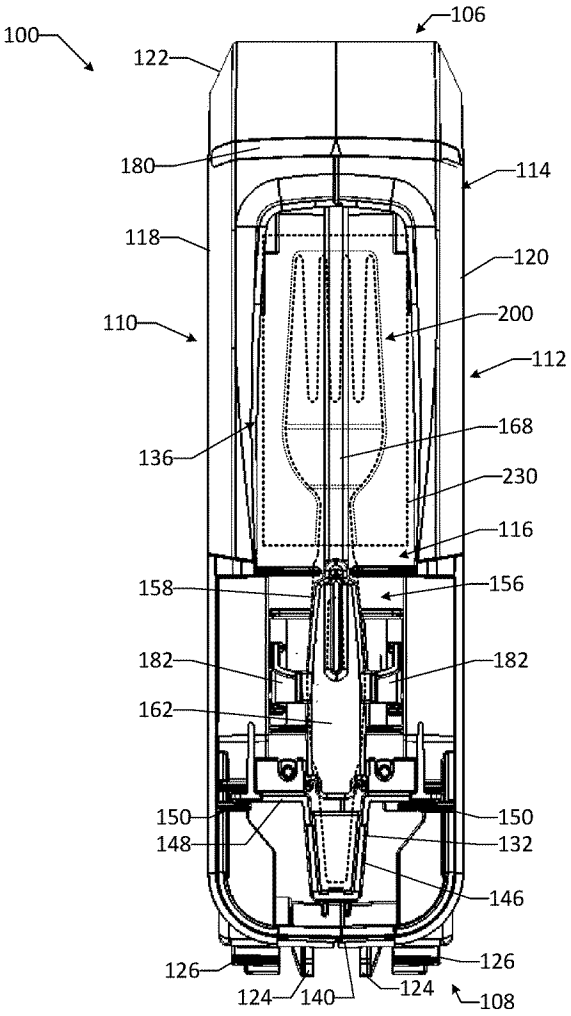
FIG. 3F is a front view of a portion of the cutlery dispenser of FIG. 1A with the front cover removed from view, showing the number of the cutlery utensils of FIG. 2A positioned within the interior space and retained therein by the sweeper arms.
Figure 3G:
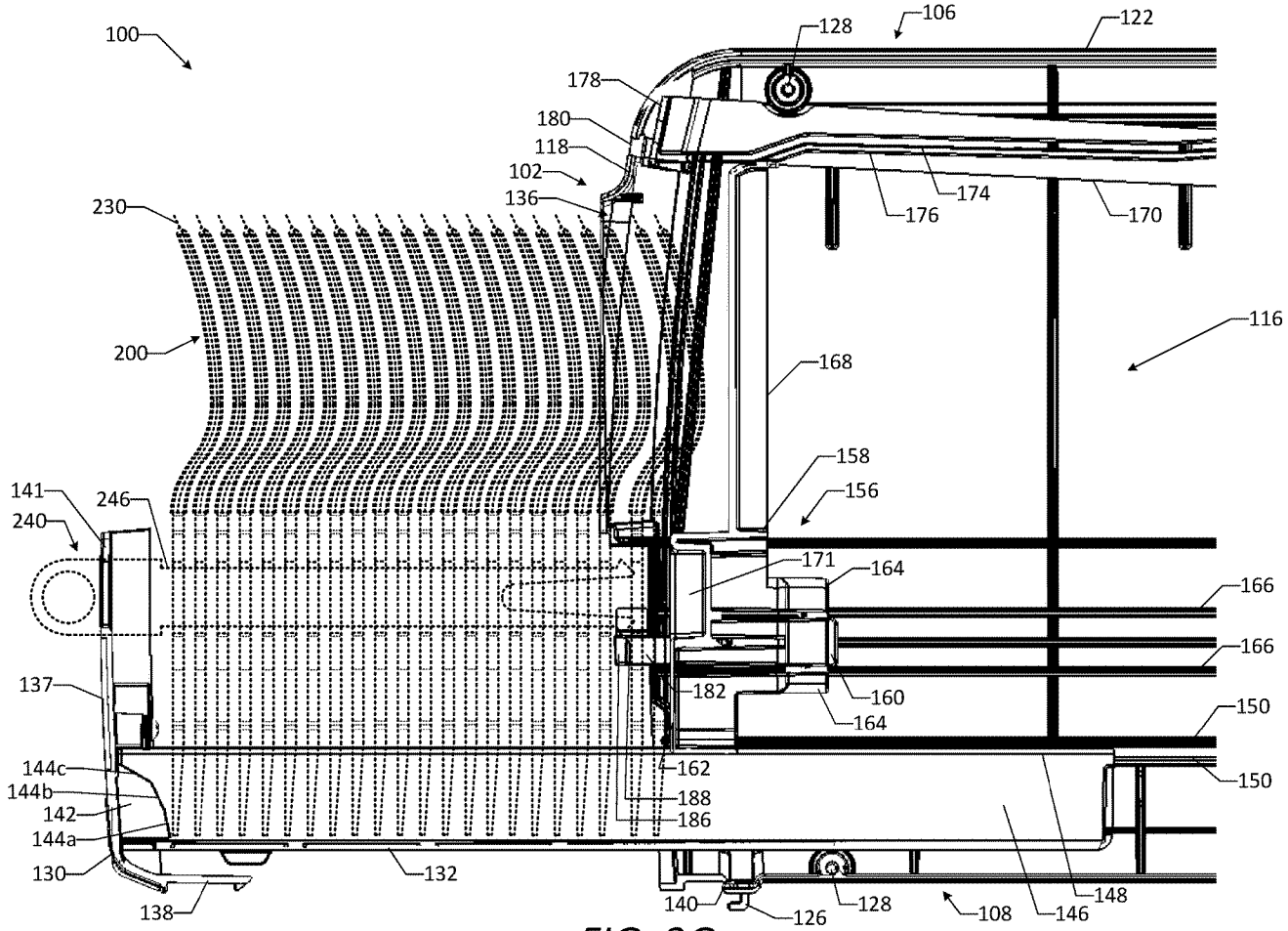
FIG. 3G is a cross-sectional side view of a portion of the cutlery dispenser of FIG. 1A, showing the front cover in an open position, the number of the cutlery utensils of FIG. 2A positioned within the interior space and retained therein by the sweeper arms, and a number of the cutlery utensils of FIG. 2A positioned on the skewer of FIG. 2E and partially within the trough of the cutlery dispenser.

FIGS. 3E-3G illustrate the function of the sweeper arms 182 when the front cover 130 is moved to an open position while a number of the cutlery utensils 200 remain loaded in the cutlery dispenser 100. As shown, in FIGS. 3E and 3F, when the front cover 130 is opened and the leading loaded cutlery utensil 200 no longer engages the wedge protrusion 142, the cutlery utensils 200 may move toward the front 102 of the dispenser 100 such that the leading loaded cutlery utensil 200 engages the contact surfaces 188 of the sweeper arms 182 and the cutlery utensils 200 assume an upright position. With the front cover 130 in an open position and the loaded cutlery utensils 200 retained by the sweeper arms 182, additional cutlery utensils 200 may be loaded into the cutlery dispenser 182 via the skewer 240, as shown in FIG. 3G. Loading of the additional cutlery utensils 200 may be carried out in the manner described above with respect to FIGS. 3A-3D. Furthermore, the skewer 240 also may be used to facilitate removal of the loaded cutlery utensils 200 from the cutlery dispenser 100. For example, the skewer 240 may be inserted through the skewer slot 141 of the front cover 130 and through the skewer apertures 208 of the loaded cutlery utensils 200, such that the utensils 200 are retained by the skewer 240. The front cover 130 then may be moved to an open position, and the cutlery utensils 200 may be pulled out of the interior space 116 of the housing 114 via the skewer 240. If more utensils remain than can be removed on one skewer, the process may be repeated until all utensils are removed.

In further embodiments, the present invention is:

A cutlery dispenser for dispensing cutlery utensils, the dispenser comprising a housing comprising an interior space configured to receive a plurality of cutlery utensils loaded therein; a cover enclosing a portion of the interior space and configured to move between a closed position for dispensing the loaded cutlery utensils from the interior space and an open position for loading the cutlery utensils into the interior space; a wedge protrusion configured to engage a leading one of the loaded cutlery utensils when the cover is in the closed position and to disengage the leading one of the loaded cutlery utensils when the cover is in an open position; and a pair of sweeper arms configured to engage the leading one of the loaded cutlery utensils when the cover is in an open position and to disengage the leading one of the loaded cutlery utensils when the cover is in the closed position.

A cutlery dispenser for dispensing cutlery utensils, the dispenser comprising a housing comprising an interior space configured to receive a plurality of cutlery utensils loaded therein; a cover enclosing a portion of the interior space and configured to move between a closed position for dispensing the loaded cutlery utensils from the interior space and an open position for loading the cutlery utensils into the interior space; and a trough attached to the cover and configured to receive handles of the loaded cutlery utensils therein, wherein the trough comprises a stop wall positioned at or near an end of the trough opposite the cover and configured to engage a trailing one of the loaded cutlery utensils when the dispenser is at a maximum fill level.

A cutlery dispenser for dispensing cutlery utensils, the dispenser comprising a housing comprising an interior space configured to receive a plurality of cutlery utensils loaded therein; a cover enclosing a portion of the interior space and configured to translate relative to the housing between a closed position for dispensing the loaded cutlery utensils from the interior space and an open position for loading the cutlery utensils into the interior space; and a trough attached to the cover and configured to receive handles of the loaded cutlery utensils therein, such that the loaded cutlery utensils are oriented in a substantially upright manner with functional heads of the loaded cutlery utensils positioned above the handles.

A cutlery dispenser for dispensing cutlery utensils, the dispenser comprising a housing comprising an interior space configured to receive a plurality of cutlery utensils loaded therein; a cover enclosing a portion of the interior space and configured to move between a closed position for dispensing the loaded cutlery utensils from the interior space and an open position for loading the cutlery utensils into the interior space; and a wedge protrusion configured to engage a leading one of the loaded cutlery utensils when the cover is in the closed position and to disengage the leading one of the loaded cutlery utensils when the cover is in an open position, wherein the wedge protrusion comprises a contact surface oriented at an acute angle relative to an interior surface of the cover.

A cutlery dispenser for dispensing cutlery utensils, the dispenser comprising a housing comprising an interior space configured to receive a plurality of cutlery utensils loaded therein; a cover enclosing a portion of the interior space and configured to move between a closed position for dispensing the loaded cutlery utensils from the interior space and an open position for loading the cutlery utensils into the interior space; and a follower arm attached to the housing and configured to pivot relative to the housing, wherein the follower arm comprises one or more indicators configured to indicate a fill level of the loaded cutlery utensils within the interior space.

A cutlery dispenser for dispensing cutlery utensils, the dispenser comprising a housing comprising an interior space configured to receive a plurality of cutlery utensils loaded therein; a cover enclosing a portion of the interior space and configured to move between a closed position for dispensing the loaded cutlery utensils from the interior space and an open position for loading the cutlery utensils into the interior space, wherein the cover comprises a slot configured to receive a skewer to facilitate loading of the cutlery utensils into the interior space.

A cutlery dispenser according to any of the previous embodiments, wherein the wedge protrusion is positioned along an interior surface of the cover.

A cutlery dispenser according to any of the previous embodiments, wherein the wedge protrusion comprises a contact surface oriented at an acute angle relative to the interior surface of the cover, and wherein the contact surface is configured to engage the leading one of the loaded cutlery utensils when the cover is in the closed position.

A cutlery dispenser according to any of the previous embodiments, further comprising a trough attached to the cover and configured to receive handles of the loaded cutlery utensils therein.

A cutlery dispenser according to any of the previous embodiments, wherein the trough comprises a stop tab, wherein the housing comprises a stop protrusion, and wherein the stop tab is configured to engage the stop protrusion when the cover is in a fully open position to limit movement of the cover relative to the housing.

A cutlery dispenser according to any of the previous embodiments, further comprising a pushing assembly positioned within the interior space and configured to move the loaded cutlery utensils toward the cover.

A cutlery dispenser according to any of the previous embodiments, wherein the pushing assembly comprises a support member configured to move relative to the housing, and a biasing member configured to bias the support member toward the cover.

A cutlery dispenser according to any of the previous embodiments, wherein the support member comprises a contact surface configured to engage a trailing one of the loaded cutlery utensils.

A cutlery dispenser according to any of the previous embodiments, wherein the biasing member comprises a constant force spring attached to the housing and configured to engage the support member.

A cutlery dispenser according to any of the previous embodiments, wherein each sweeper arm comprises a contact surface configured to engage the leading one of the loaded cutlery utensils when the cover is in an open position.

A cutlery dispenser according to any of the previous embodiments, wherein each sweeper arm comprises a lead-in surface configured to engage the cutlery utensils as the cutlery utensils are inserted into the interior space.

A cutlery dispenser according to any of the previous embodiments, wherein the sweeper arms are spaced apart from one another and configured to deflect away from one another as the cutlery utensils are inserted into the interior space.

A cutlery dispenser according to any of the previous embodiments, further comprising a follower arm attached to the housing and configured to pivot relative to the housing when the cover moves between the closed position and an open position.

A cutlery dispenser according to any of the previous embodiments, further comprising a dispensing opening defined by the housing and the cover and configured to allow the loaded cutlery utensils to be dispensed therethrough.

A cutlery dispenser according to any of the previous embodiments, wherein the wedge protrusion is configured to tilt the leading one of the loaded cutlery utensils when the cover is in the closed position, such that a portion of the leading one of the loaded cutlery utensils extends through the dispensing opening.

A cutlery dispenser according to any of the previous embodiments, wherein the stop wall extends vertically along a height of the trough.

A cutlery dispenser according to any of the previous embodiments, further comprising a wedge protrusion configured to engage a leading one of the loaded cutlery utensils when the cover is in the closed position and to disengage the leading one of the loaded cutlery utensils when the cover is in an open position; and a pair of sweeper arms configured to engage the leading one of the loaded cutlery utensils when the cover is in an open position and to disengage the leading one of the loaded cutlery utensils when the cover is in the closed position.

A cutlery dispenser according to any of the previous embodiments, further comprising a dispensing opening defined by the housing and the cover and configured to allow the loaded cutlery utensils to be dispensed therethrough.

A cutlery dispenser according to any of the previous embodiments, wherein the wedge protrusion is part of the cover.

A cutlery dispenser according to any of the previous embodiments, further comprising a trough attached to the cover and configured to receive handles of the loaded cutlery utensils therein.

A cutlery dispenser according to any of the previous embodiments, wherein the wedge protrusion is part of the trough.

A cutlery dispenser according to any of the previous embodiments, wherein the contact surface comprises a planar surface.

A cutlery dispenser according to any of the previous embodiments, wherein the wedge protrusion comprises a plurality of contact surfaces each oriented at an acute angle relative to the interior surface of the cover.

A cutlery dispenser according to any of the previous embodiments, wherein the follower arm is positioned within the interior space.

A cutlery dispenser according to any of the previous embodiments, further comprising an indicator window configured to allow a user to view the one or more indicators.

A cutlery dispenser according to any of the previous embodiments, wherein the one or more indicators comprises a plurality of indicators.

A cutlery dispenser according to any of the previous embodiments, further comprising a pushing assembly positioned within the interior space and configured to move the loaded cutlery utensils toward the cover.

A cutlery dispenser according to any of the previous embodiments, wherein the pushing assembly comprises a support member configured to move relative to the housing, and a biasing member configured to bias the support member toward the cover.

A cutlery dispenser according to any of the previous embodiments, wherein the follower arm is configured to pivot relative to the housing when the support member moves relative to the housing.

A cutlery dispenser according to any of the previous embodiments, wherein the support member is configured to translate relative to the housing.

A cutlery dispenser according to any of the previous embodiments, wherein the slot extends from a top of the cover.

A cutlery dispenser according to any of the previous embodiments, wherein the slot extends vertically.

A cutlery dispenser according to any of the previous embodiments, further comprising a dispensing opening defined by the housing and the cover and configured to allow the loaded cutlery utensils to be dispensed therethrough.

A cutlery dispenser according to any of the previous embodiments, wherein the slot is in communication with the dispensing opening.

A cutlery dispenser according to any of the previous embodiments, wherein the cover is configured to translate relative to the housing.

It should be apparent that the foregoing relates only to certain embodiments of the present disclosure. Numerous changes and modifications may be made herein by one of ordinary skill in the art without departing from the general spirit and scope of the invention as defined by the following claims and equivalents thereof.

I claim:

1. A cutlery dispenser for dispensing cutlery utensils, the dispenser comprising:

a housing comprising an interior space configured to receive a plurality of cutlery utensils loaded therein;

a cover enclosing a portion of the interior space and configured to translate along a linear path relative to the housing between a closed position for dispensing the loaded cutlery utensils from the interior space and an open position for loading the cutlery utensils into the interior space;

a wedge protrusion configured to engage a leading one of the loaded cutlery utensils when the cover is in the closed position and to disengage the leading one of the loaded cutlery utensils when the cover is in an open position; and a pair of sweeper arms configured to engage the leading one of the loaded cutlery utensils when the cover is in an open position and to disengage the leading one of the loaded cutlery utensils when the cover is in the closed position;

wherein the wedge protrusion is configured to tilt the leading one of the loaded cutlery utensils such that the leading one of the cutlery utensils disengages the sweeper arms when the cover is in the closed position.

2. The cutlery dispenser of claim 1, wherein the sweeper arms are spaced apart from one another and configured to deflect away from one another as the cutlery utensils are inserted into the interior space, and wherein each sweeper arm comprises:

a lead-in surface configured to engage the cutlery utensils as the cutlery utensils are inserted into the interior space; and a contact surface configured to engage the leading one of the loaded cutlery utensils when the cover is in an open position.

3. The cutlery dispenser of claim 1, wherein the cover comprises a slot configured to receive a skewer to facilitate loading of the cutlery utensils into the interior space.

4. The cutlery dispenser of claim 1, wherein the wedge protrusion is positioned along an interior surface of the cover.

5. The cutlery dispenser of claim 4, wherein the wedge protrusion comprises a contact surface oriented at an acute angle relative to the interior surface of the cover, and wherein the contact surface is configured to engage the leading one of the loaded cutlery utensils when the cover is in the closed position.

6. The cutlery dispenser of claim 1, further comprising a trough attached to the cover and configured to translate therewith when the cover is translated between the closed position and the open position, wherein the trough is configured to receive handles of the loaded cutlery utensils therein, and wherein the wedge protrusion is positioned at least partially within the trough.

7. The cutlery dispenser of claim 6, wherein the trough comprises a stop tab, wherein the housing comprises a stop protrusion, and wherein the stop tab is configured to engage the stop protrusion when the cover is in a fully open position to limit movement of the cover relative to the housing.

8. The cutlery dispenser of claim 1, further comprising a pushing assembly positioned within the interior space and configured to move the loaded cutlery utensils toward the cover, wherein the pushing assembly comprises a support member configured to move relative to the housing and to engage a trailing one of the loaded cutlery utensils.

9. The cutlery dispenser of claim 8, further comprising a follower arm engaging the support member and configured to move relative to the housing when the support member moves relative to the housing.

10. The cutlery dispenser of claim 9, wherein the follower arm comprises a plurality of indicators configured to indicate a fill level of the loaded cutlery utensils, and wherein at least one of the indicators is visible through an indicator window of the housing.

11. The cutlery dispenser of claim 9, wherein the support member is configured to translate along a linear path relative to the housing, and wherein the follower arm is configured to pivot relative to the housing when the support member translates relative to the housing.

12. The cutlery dispenser of claim 1, further comprising a dispensing opening defined by the housing and the cover and configured to allow the loaded cutlery utensils to be dispensed therethrough.

13. The cutlery dispenser of claim 12, wherein the wedge protrusion is configured to tilt the leading one of the loaded cutlery utensils such that a portion of the leading one of the cutlery utensils extends through the dispensing opening when the cover is in the closed position.

14. The cutlery dispenser of claim 13, further comprising a dispensing opening defined by the housing and the cover and configured to allow the loaded cutlery utensils to be dispensed therethrough, wherein the slot is in communication with the dispensing opening.

15. A cutlery dispenser for dispensing cutlery utensils, the dispenser comprising:

a housing comprising an interior space configured to receive a plurality of cutlery utensils loaded therein;

a cover enclosing a portion of the interior space and configured to move relative to the housing between a closed position for dispensing the loaded cutlery utensils from the interior space and an open position for loading the cutlery utensils into the interior space; and a trough attached to the cover and configured to move therewith when the cover is moved between the closed position and the open position, wherein the trough comprises:

a base configured to receive handles of the loaded cutlery utensils therein; and a stop wall positioned at or near an end of the trough opposite the cover and fixed relative to the base, wherein the stop wall is configured to engage a trailing one of the loaded cutlery utensils when the dispenser is at a maximum fill level.

16. The cutlery dispenser of claim 15, wherein the cover is configured to translate along a linear path relative to the housing between the closed position and the open position, and wherein the base is configured to receive the handles of the loaded cutlery utensils therein, such that the loaded cutlery utensils are oriented in a substantially upright manner with functional heads of the loaded cutlery utensils positioned above the handles.

17. The cutlery dispenser of claim 16, further comprising:

a dispensing opening defined by the housing and the cover and configured to allow the loaded cutlery utensils to be dispensed therethrough.

18. The cutlery dispenser of claim 16, further comprising:

a wedge protrusion configured to engage a leading one of the loaded cutlery utensils when the cover is in the closed position and to disengage the leading one of the loaded cutlery utensils when the cover is in an open position; and a pair of sweeper arms configured to engage the leading one of the loaded cutlery utensils when the cover is in an open position and to disengage the leading one of the loaded cutlery utensils when the cover is in the closed position;

wherein the wedge protrusion is configured to tilt the leading one of the loaded cutlery utensils such that the leading one of the cutlery utensils disengages the sweeper arms when the cover is in the closed position.

19. A cutlery dispenser for dispensing cutlery utensils, the dispenser comprising:

a housing comprising an interior space configured to receive a plurality of cutlery utensils loaded therein, wherein the housing has a first height extending from a top end to a bottom end of the housing;

a cover enclosing a portion of the interior space and configured to translate along a linear path relative to the housing between a closed position for dispensing the loaded cutlery utensils from the interior space and an open position for loading the cutlery utensils into the interior space, wherein the cover has a second height extending from a top end to a bottom end of the cover, wherein the second height is less than the first height, and wherein the cover comprises a slot extending from the top end toward the bottom end of the cover and configured to receive a skewer to facilitate loading of the cutlery utensils into the interior space; and a dispensing opening defined by the housing and the cover and configured to allow the loaded cutlery utensils to be dispensed therethrough, wherein the slot is in communication with the dispensing opening.

20. The cutlery dispenser of claim 19, wherein the dispensing opening is defined by the housing and the top end of the cover, and wherein the slot extends vertically from the top end toward the bottom end of the cover.

21. The cutlery dispenser of claim 19, wherein the dispensing opening has a first width, wherein the slot has a second width, and wherein the second width is less than the first width.

22. The cutlery dispenser of claim 19, wherein the slot extends from an exterior surface of the cover to an interior surface of the cover and is in communication with the interior space.

* * * * *